US005543177A

United States Patent [19]

Morrison et al.

[11] Patent Number: 5,543,177

[45] Date of Patent: Aug. 6, 1996

[54] MARKING MATERIALS CONTAINING RETROREFLECTING FILLERS

[75] Inventors: Jan D. Morrison; Edward F. Grabowski, both of Webster; Virginia E. Dotschkal, Newark; Anita P. Lynch, Webster; Jerome E. May, Pittsford, all of N.Y.

[73] Assignee: Xerox Corporation, Stamford, Conn.

[21] Appl. No.: 161,619

[22] Filed: Dec. 6, 1993

Related U.S. Application Data

[63] Continuation-in-part of Ser. No. 971,742, Nov. 5, 1992, Pat. No. 5,397,673.

[51] Int. Cl.[6] ..... B25D 5/00

[52] U.S. Cl. ..... 427/288; 73/150 R; 101/491; 430/114; 430/124; 523/217

[58] Field of Search ..... 427/288; 73/150 R; 101/491; 106/190, 200; 430/114, 124; 523/217

[56] References Cited

U.S. PATENT DOCUMENTS

| | | | |
|---|---|---|---|
| Re. 32,967 | 6/1989 | St. John et al. | 242/57.1 |
| 4,135,664 | 1/1979 | Resh | 235/475 |
| 4,355,055 | 10/1982 | Buska et al. | 427/96 |
| 4,752,502 | 6/1988 | Wincherrer | 427/137 |
| 4,912,491 | 3/1990 | Hoshino et al. | 346/160 |
| 4,948,686 | 8/1990 | Koch et al. | 430/45 |
| 4,963,899 | 10/1990 | Resch, III | 346/157 |
| 4,999,076 | 3/1991 | Incremona et al. | 427/152 X |
| 5,145,518 | 9/1992 | Winnik et al. | 106/21 |
| 5,160,946 | 11/1992 | Hwang | 346/157 |
| 5,175,564 | 12/1992 | Jamzaden | 346/108 |
| 5,175,570 | 12/1992 | Haneda et al. | 346/160 |
| 5,204,620 | 4/1993 | Costanza et al. | 324/175 |
| 5,208,796 | 5/1993 | Wong et al. | 369/97 |
| 5,225,900 | 7/1993 | Wright | 358/75 |
| 5,283,148 | 2/1994 | Rao | 430/119 X |
| 5,286,682 | 2/1994 | Jacobs et al. | 501/34 |
| 5,296,331 | 3/1994 | Taguchi | 427/195 X |

*Primary Examiner*—Michael Lusignan
*Attorney, Agent, or Firm*—Judith L. Byorick

[57] ABSTRACT

Disclosed are marking materials containing retroreflective fillers and processes for the use thereof. In one embodiment, images containing retroreflective fillers are generated on paper by any suitable means, such as electrostatic imaging and development with either dry or liquid developers, ink jet printing, strip-out development processes, or the like, and the images thus generated are used to control a document reproduction system. In another embodiment, images containing retroreflective fillers are generated on a movable part in an imaging apparatus, such as an imaging member, an intermediate transfer member, or the like, by any suitable means, and the images thus generated are used to impart information regarding the relative position of the movable part with respect to the copier or printer containing the movable part.

35 Claims, 5 Drawing Sheets

MARKING MATERIALS CONTAINING RETROREFLECTING FILLERS

This application is a continuation-in-part of copending application U.S. Ser. No. 07/971,742, filed Nov. 5, 1992, entitled "Curable Strip-Out Development Process," the disclosure of which is totally incorporated herein by reference, now U.S. Pat. No. 5,397,673, patented Mar. 14, 1995.

BACKGROUND OF THE INVENTION

The present invention is directed to marking materials containing retroreflective fillers. In one embodiment, the marking materials are capable of generating images that are not easily visible under ordinary viewing conditions but which are capable of being rendered readable either by the human eye or by a machine. In another embodiment, the marking materials are capable of generating images that are visible and which can be distinguished from other visible marking materials that don't contain the retroreflective filler, either by the human eye under special viewing conditions or by a machine. One specific embodiment of the present invention is directed to a process for generating images on paper which comprises applying in imagewise fashion to the paper a marking material containing a retroreflective filler material. Another embodiment of the present invention is directed to a toner composition for the development of electrostatic latent images which comprises a thermoplastic resin and a retroreflective filler material. Yet another embodiment of the present invention is directed to a process for generating images which comprises generating an electrostatic latent image on an imaging member in an imaging apparatus; developing the latent image with a toner comprising a thermoplastic resin and a retroreflecting filler material; optionally transferring the developed image to a substrate; and optionally permanently affixing the transferred image to the substrate. Still another embodiment of the present invention is directed to an imaging process which comprises (1) charging an imaging member in an imaging apparatus; (2) creating on the member a latent image comprising areas of high, intermediate, and low potential; (3) developing the low areas of potential with a first developer comprising a first toner comprising a thermoplastic resin, an optional colorant, and an optional retroreflecting filler; (4) subsequently developing the high areas of potential with a second developer comprising a second toner comprising a thermoplastic resin, an optional colorant, and an optional retroreflecting filler; and (5) transferring the developed images to a substrate, wherein a retroreflecting filler is necessarily present in either the first toner or the second toner, and wherein a colorant is necessarily present in a toner containing no retroreflecting filler. Another embodiment of the present invention is directed to a process which comprises incorporating into an ink jet printer an ink composition comprising a vehicle, an optional colorant, and a retroreflecting filler, and causing droplets of the ink composition to be ejected in an imagewise pattern onto a substrate. In a preferred embodiment, the ink comprises an aqueous liquid vehicle and the ink is incorporated into a thermal ink jet printer. Yet another embodiment of the present invention is directed to a process for generating images which comprises generating an electrostatic latent image on an imaging member in an imaging apparatus; developing the latent image with a toner comprising a thermoplastic resin and a colorant; transferring the developed image to a substrate; optionally permanently affixing the transferred image to the substrate; and causing droplets of an ink composition comprising an aqueous liquid vehicle, an optional colorant, and a retroreflecting filler to be ejected in an imagewise pattern onto the substrate. Still another embodiment of the present invention is directed to an ink composition which comprises an aqueous liquid vehicle and a retroreflective filler material, said ink composition having a viscosity of no more than about 5 centipoise. Another embodiment of the present invention is directed to a liquid developer for the development of electrostatic latent images which comprises a nonaqueous liquid vehicle, an optional charge control agent, and retroreflective filler particles, said developer having a resistivity of at least about $10^8$ and a viscosity of no more than 500 centipoise at the temperature at which development occurs. Yet another embodiment of the present invention is directed to an imaging process which comprises generating an electrostatic latent image on an imaging member and contacting the latent image with a liquid developer comprising a nonaqueous liquid vehicle, a charge control agent, and toner particles comprising retroreflective filler particles, thereby causing the toner particles to migrate through the liquid and develop the latent image. Still another embodiment of the present invention is directed to an imaging process which comprises generating an electrostatic latent image on an imaging member, applying to an applicator a liquid developer comprising a nonaqueous liquid vehicle and retroreflective filler particles, and bringing the applicator into sufficient proximity with the latent image to cause the image to attract the developer onto the imaging member, thereby developing the image. Another embodiment of the present invention is directed to an imaging process which comprises applying a liquid to a substrate in imagewise fashion, followed by applying retroreflective filler particles to the liquid image. Yet another embodiment of the present invention is directed to a process for controlling a reproduction system, comprising the steps of: (1) scanning an image to detect retroreflective filler material in at least one marking material forming the image; and (2) issuing instructions to the reproduction system, wherein the instructions cause the reproduction system to take an action selected from the group consisting of: (a) prohibiting reproduction of those portions of the image formed by marking material containing retroreflective filler material, and reproducing of all other portions of the image; (b) prohibiting reproduction of any part of the image upon detection of retroreflective filler material; (c) reproducing only those portions of the image formed by marking material containing retroreflective filler material; (d) reproducing portions of the image formed by marking material containing retroreflective filler material in a different manner from that in which the system reproduces portions of the image formed by marking material not containing retroreflective filler material; and (e) identifying a source of the image on the basis of detection of retroreflective filler material. Still another embodiment of the present invention is directed to a process for determining the relative position of a movable component in an imaging apparatus which comprises (a) providing on the movable component at least one mark with a marking material containing a retroreflective filler material; (b) positioning an illumination source so that illumination from the illumination source strikes the mark on the movable component; (c) positioning an illumination detector so that it can detect illumination reflected from the retroreflective filler material on the movable component; and (d) calculating the relative position of the movable component using information provided from the illumination detector.

U.S. Pat. No. 4,948,686 (Koch et al.), the disclosure of which is totally incorporated herein by reference, discloses a process for forming two-color images which comprises charging an imaging member, creating on the member a latent image comprising areas of high, medium, and low potential, developing the low areas of potential with a developer comprising a specific colored toner and a specific carrier, subsequently developing the high areas of potential with a developer comprising a specific black toner and a specific carrier, transferring the developed two-color image to a substrate, and permanently affixing the image to the substrate.

U.S. Pat. No. 4,135,664 (Resh), the disclosure of which is totally incorporated herein by reference, discloses a lateral register control system utilizing a reference lateral and circumferential mark pair preprinted on the web which is compared with a corresponding mark pair mounted on a drum coupled to the shaft of the print cylinder whose reference is to be controlled. The clock source is an encoder connected to the same print stand as laid down the reference marks on the web. The contents of the cylinder position counters are always slightly greater than the contents of the scanner difference counters and are counted up slightly before the scanner difference counters. Upon sensing a first reference mark on the web, the scanner difference counters are permitted to count. Upon the second reference mark being sensed, the fine adjust counters are permitted to start counting. Upon the contents of the fine adjust counters equaling the value of operator setable fine adjust switches, an error pulse train is generated having an associated sign. The error pulse train is accumulated in a repeat counter and is terminated when the contents of the scanner difference counters equal the contents of the cylinder position counters. The error magnitude may be averaged over several cycles or output directly to a digital analog converter which produces an analog error magnitude. This magnitude serves as the input to the motor control circuitry. The motor control circuitry is operable to drive the print cylinder lateral position motor at a rate proportional to the analog error signal and in the direction indicated by the sign of the error signal.

U.S. Pat. No. 5,175,570 (Haneda et al.), the disclosure of which is totally incorporated herein by reference, discloses a color image forming apparatus in which at least one registration mark is formed on a movable image retainer, and exposed by an exposing device. A position of the registration mark is detected by a detecting device and a signal is generated based on the detected position of the registration mark. An exposing position of the exposing device is corrected by a correcting device in accordance with the signal to form a latent image on the image retainer.

U.S. Pat. No. 5,175,564 (Jamzadeh), the disclosure of which is totally incorporated herein by reference, discloses a color printer which includes a recording element which is advanced along a path to receive color-separation images of a desired multicolor image to be printed. Color-separation image recording is effected by a laser scanner which operates asynchronously with respect to the movement of the recording element and functions to periodically scan an intensity-modulated beam of radiation across the moving recording element to record a multitude of equally spaced image lines that collectively define a two-dimensional latent image. In response to a print enable signal, the laser scanner begins scanning the first line of a color-separation image at any time within a line-time interval required to scan each image line. According to a preferred embodiment of the invention, the print enable signal is provided a predetermined fraction of the line-time interval earlier for the second and subsequent color-separation images of a desired multicolor image than it is for the first color-separation image. In this manner the color-separated images are better registered with respect to a nominal position on the recording element.

U.S. Pat. Re. 32,967 (St. John et al.), the disclosure of which is totally incorporated herein by reference, discloses a web tracking system for a continuous web of material which is transported from a supply to a takeup means along a predetermined path via one or more processing stations and comprises aligned tracking indicia along at least one edge of the web. Means are provided to observe the tracking indicia as the web is transported along the system path and produce information either indicative of dimensional changes in the length and width of the web due to web shrinkage or expansion or indicative of a particular point along the length of the web useful at one or more of the processing stations in the system.

U.S. Pat. No. 4,963,899 (Resch), the disclosure of which is totally incorporated herein by reference, discloses an image frame registration apparatus and method which have particular utility in a printing or reproduction apparatus that processes multiple image frames on a transported photosensitive member. Registration indicia for registering an image frame are written on the photosensitive member in an interframe or frame margin area. The indicia are composed of discharged line patterns that are readable by a sensor array according to the charge variation or, after toning, the pattern of toned lines therein. The sensor array provides in-track and cross-track signal information to a control unit for synchronizing the electrostatographic processing of the registered image frames. In particular, servo-controlled drive means in the exposure and transfer stations are controlled with precision to provide, after the development and transfer of several registered component images to one or more receivers, an accurate multicolor reproduction.

U.S. Pat. No. 4,912,491 (Hoshino et al.), the disclosure of which is totally incorporated herein by reference, discloses an image forming apparatus for forming superimposed images which includes a plurality of image forming devices each for forming a different image and a registration mark, corresponding to the position of the associated image, on an image transferring medium. The registration mark is formed on a transparent part of the medium and is illuminated from below. A detector above the medium detects the position of the shadow of the registration mark for each image and the result of detection is used to adjust the position of at least one image forming device to produce proper registration between the images formed by the respective image forming devices.

U.S. Pat. No. 5,208,796 (Wong et al.), the disclosure of which is totally incorporated herein by reference, discloses a method and apparatus for transverse registration of image exposures on photoreceptive belts subject to lateral deviation from linear travel in which targets, corresponding in location to the image areas to be exposed, are used for the detection of lateral belt displacement and to control the transverse location of exposure scan. The targets are of a pattern defining a reference line and a line inclined with respect to the direction of belt travel so that the duration of time between passage of the target lines with respect to a spatially fixed sensing axis will vary with lateral displacement of the belt. The targets may assume a variety of specific patterns and the invention is applicable to single and multipass image exposure systems as well as to both modulated laser and light emitting diode types of exposure devices.

U.S. Pat. No. 5,204,620 (Costanza et al.), the disclosure of which is totally incorporated herein by reference, discloses a method for measuring accurately the actual position and velocity of a photoreceptor belt by sensing the passing of illuminated holes in the belt, as the belt moves in a process direction. A segmented sensor array is positioned so as to view the passing of the illuminated holes. A Gaussian light intensity distribution is sensed by a group of sensor pixels which sense the light during a sampling interval. The array produces an output which is operated upon by a centroid processor to determine the center of moment for each sampled intensity distribution. A prediction is then made for projected position of the belt which is very accurate since the centroid calculation is not affected by noise produced by stray light or poorly defined image edges.

U.S. Pat. No. 5,160,946 (Hwang), the disclosure of which is totally incorporated herein by reference, discloses an electrophotographic printing machine which utilizes an improved image registration system that forms and senses image registration indicia to control a subsequent transfer of a visible image. A first transfer station transfers registration indicia, previously formed on a first photoconductive member and transferred therefrom, onto a receiving member. A sensor monitors the registration indicia on the receiving member and generates a control signal indicative thereof. A second transfer station, responsive to the control signal, transfers a visible image, previously formed on a second photoconductive member and transferred therefrom, to the receiving member.

Further information with respect to registration marks on imaging members is disclosed in, for example, copending application U.S. Ser. No. 07/807,927, filed Dec. 16, 1991, now U.S. Pat. No. 5,302,973, entitled "Method and Apparatus for Image Registration In a Single Pass ROS," with the named inventors Daniel W. Costanza and William J. Nowak, the disclosure of which is totally incorporated herein by reference; copending application U.S. Ser. No. 07/946,703, filed Sep. 18, 1992, now U.S. Pat. No. 5,260,725, entitled "Method and Apparatus for Registration of Sequential Images in a Single Pass, Color Xerographic Printer," with the named inventor Thomas J. Hammond, the disclosure of which is totally incorporated herein by reference; copending application U.S. Ser. No. 07/931,802, filed Aug. 18, 1992, now U.S. Pat. No. 5,278,625, entitled "Method and Apparatus for Lateral Registration of Sequential Images in a Single Pass Multi-LED Print Bar Printer," with the named inventors George A. Charnitski and Jacob N. Kluger, the disclosure of which is totally incorporated herein by reference; copending application U.S. Ser. No. 07/859,746, filed Mar. 30, 1992, entitled "Apparatus for Transverse Image Registration of a Photoreceptor Belt," with the named inventors Ssujan Hou and Lam F. Wong, the disclosure of which is totally incorporated herein by reference; copending application U.S. Ser. No. 07/991,228, filed Dec. 16, 1992, now U.S. Pat. No. 5,321,434, entitled "Digital Color Printer With Improved Lateral Registration," with the named inventors Andrew M. Strauch, Fred F. Hubble III, and Kenneth R. Ossman, the disclosure of which is totally incorporated herein by reference; copending application U.S. Ser. No. 07/970,889, filed Nov. 3, 1992, now U.S. Pat. No. 5,278,587, entitled "Method and Apparatus for Image Registration," with the named inventors Andrew M. Strauch, Daniel W. Costanza, Kenneth R. Ossman, and Fred F. Hubble III, the disclosure of which is totally incorporated herein by reference; copending application U.S. Ser. No. 08/055,335, filed May 3, 1992, now U.S. Pat. No. 5,412,409, entitled "Image Registration For a Raster Output Scanner (ROS) Color Printer," with the named inventor Daniel W. Costanza, the disclosure of which is totally incorporated herein by reference; copending application U.S. Ser. No. 07/995,650, filed Dec. 18, 1992, entitled "Transverse Image Registration For a Digital Color Printer," with the named inventor Edward A. Powers, the disclosure of which is totally incorporated herein by reference; copending application U.S. Ser. No. 07/807,931, filed Dec. 16, 1991, now U.S. Pat. No. 5,300,961, entitled "Method and Apparatus for Aligning Multiple Image Print Bars in a Single Pass System," with the named inventors Stephen C. Corona and George A. Charnitski, the disclosure of which is totally incorporated herein by reference; copending application U.S. Ser. No. 07/821,526, filed Jan. 16, 1992, now U.S. Pat. No. 5,442,388, entitled "Method and Means for Correcting Lateral Registration Errors," with the named inventor Richard A. Schieck, the disclosure of which is totally incorporated herein by reference; copending application U.S. Ser. No. 07/992,685, filed Dec. 18, 1992, now U.S. Pat. No. 5,248,027, entitled "Method and Apparatus for Belt Steering Control," with the named inventors Jacob N. Kluger, Ssujan Hou, Lam F. Wong, and Stephen C. Arnone, the disclosure of which is totally incorporated herein by reference; copending application U.S. Ser. No. 07/862,150, filed Apr. 2, 1992, now U.S. Pat. No. 5,272,493, entitled "Method and Apparatus for Registration of Sequential Images in a Single Pass, Multi-LED Printbar Printer," with the named inventors Fred F. Hubble III, Thomas J. Hammond, and James P. Martin, the disclosure of which is totally incorporated herein by reference; copending application U.S. Ser. No. 08/063,796, filed May 20, 1993, now U.S. Pat. No. 5,383,014, entitled "Photoreceptor Belt Motion Sensor Using Linear Position Sensors," with the named inventors William J. Nowak, Daniel W. Costanza, Edward A. Powers, the disclosure of which is totally incorporated herein by reference; and copending application U.S. Ser. No. 08/035,830, filed Mar. 23, 1993, now U.S. Pat. No. 5,339,150, entitled "Mark Detection Circuit for an Electrographic Printing Machine," with the named inventors Fred F. Hubble Ill, James P. Martin, and Jeffrey J. Folkins, the disclosure of which is totally incorporated herein by reference, and in U.S. Pat. No. 4,837,636, U.S. Pat. No. 4,893,135, U.S. Pat. No. 4,916,547, U.S. Pat. No. 4,804,979, U.S. Pat. No. 4,401,024, U.S. Pat. No. 4,965,597, U.S. Pat. No. 4,903,067, and U.S. Pat. No. 5,016,062, the disclosures of each of which are totally incorporated herein by reference.

U.S. Pat. No. 5,225,900 (Wright), the disclosure of which is totally incorporated herein by reference, discloses apparatuses and processes for controlling a reproduction system by scanning an image to detect at least one taggant in at least one marking material forming the image and issuing instructions to the reproduction system; the instructions cause the reproduction system to take an action selected from the group consisting of (a) prohibiting reproduction of those portions of the image formed by a marking material containing at least one predetermined detected taggant and reproducing all other portions of the image; (b) prohibiting reproduction of any part of the image upon detection of at least one predetermined taggant; (c) reproducing only those portions of the image formed by a marking material containing at least one predetermined taggant; (d) reproducing portions of the image formed by a marking material containing at least one predetermined taggant in a different manner from that in which the system reproduces portions of the image formed by a marking material not containing at least one predetermined taggant; and (e) identifying a source of the image on the basis of detection of at least one predetermined taggant.

U.S. Pat. No. 5,145,518 (Winnik et al.), the disclosure of which is totally incorporated herein by reference, discloses an ink composition which comprises an aqueous liquid vehicle and particles of an average diameter of 100 nanometers or less which comprise micelies of block copolymers of the formula ABA, wherein A represents a hydrophilic segment and B represents a hydrophobic segment, and wherein dye molecules are covalently attached to the micelies, said dye molecules being detectable when exposed to radiation outside the visible wavelength range. Optionally, silica is precipitated within the micelies. In a specific embodiment, the dye molecules are substantially colorless. In another specific embodiment, the ink also contains a colorant detectable in the visible wavelength range.

Although known compositions and processes are suitable for their intended purposes, a need remains for marking materials capable of generating images that are not easily visible under ordinary viewing conditions but which are capable of being rendered readable either by the human eye or by a machine. In addition, a need remains for marking materials capable of generating images that are visible and which can be distinguished from other visible marking materials that do not contain the retroreflective filler, either by the human eye under special viewing conditions or by a machine. Further, there is a need for marking materials capable of generating images that are detectable with retroreflecting optics wherein the detector is substantially colinear with the illumination source and the angle of illumination is off the normal. Additionally, a need remains for processes wherein both visible images and images substantially invisible to the naked eye but capable of detection by either a machine or by the human eye under special viewing conditions are applied to a substrate by an electrophotographic process in a single development pass. There is also a need for processes wherein images of two different colored toners are both applied to a substrate by an electrophotographic process in a single development pass, with at least one of the colored toners contains a retroreflective filler material capable of detection by either a machine or by the human eye under special viewing conditions. In addition, a need exists for processes wherein a first image is applied to a substrate by an electrophotographic process and a second image is applied to the substrate by an ink jet printing process, wherein one of the images contains retroreflective filler material capable of detection by either a machine or by the human eye under special viewing conditions. Further, there is a need for processes for placing encoded information in a document in a manner not distracting or easily visible to the casual user. Additionally, there is a need for methods for placing timing marks on moving components of imaging apparatuses, such as imaging members, intermediate transfer elements, or the like to enable optical detectors to determine the relative position of a particular portion of the member with respect to the rest of the machine.

SUMMARY OF THE INVENTION

It is an object of the present invention to provide a marking material with the above noted advantages.

It is another object of the present invention to provide a marking material capable of generating images that are not easily visible under ordinary viewing conditions but which are capable of being rendered readable either by the human eye or by a machine.

It is yet another object of the present invention to provide a marking material capable of generating images that are visible and which can be distinguished from other visible marking materials that do not contain the retroreflective filler, either by the human eye under special viewing conditions or by a machine.

It is still another object of the present invention to provide a marking material capable of generating images that are detectable with retroreflecting optics wherein the detector is substantially colinear with the illumination source and the angle of illumination is off the normal.

Another object of the present invention is to provide processes wherein both visible images and images substantially invisible to the naked eye but capable of detection by either a machine or by the human eye under special viewing conditions are applied to a substrate by an electrophotographic process in a single development pass.

Yet another object of the present invention is to provide processes wherein images of two different colored toners are both applied to a substrate by an electrophotographic process in a single development pass, with at least one of the colored toners contains a retroreflective filler material capable of detection by either a machine or by the human eye under special viewing conditions.

Still another object of the present invention is to provide processes wherein a first image is applied to a substrate by an electrophotographic process and a second image is applied to the substrate by an ink jet printing process, wherein at least one of the images contains retroreflective filler material capable of detection by either a machine or by the human eye under special viewing conditions.

It is another object of the present invention to provide processes for placing encoded information in a document in a manner not distracting or easily visible to the casual user.

It is yet another object of the present invention to provide methods for placing timing marks on moving components of imaging apparatuses, such as imaging members, intermediate transfer elements, or the like to enable optical detectors to determine the relative position of a particular portion of the member with respect to the rest of the machine.

These and other objects of the present invention (or specific embodiments thereof) can be achieved by providing a process for generating images on paper which comprises applying in imagewise fashion to the paper a marking material containing a retroreflective filler material. Another embodiment of the present invention is directed to a toner composition for the development of electrostatic latent images which comprises a thermoplastic resin and a retroreflective filler material. Yet another embodiment of the present invention is directed to a process for generating images which .comprises generating an electrostatic latent image on an imaging member in an imaging apparatus; developing the latent image with a toner comprising a thermoplastic resin and a retroreflecting filler material; optionally transferring the developed image to a substrate; and optionally permanently affixing the transferred image to the substrate. Still another embodiment of the present invention is directed to an imaging process which comprises (1) charging an imaging member in an imaging apparatus; (2) creating on the member a latent image comprising areas of high, intermediate, and low potential; (3) developing the low areas of potential with a first developer comprising a first toner comprising a thermoplastic resin, an optional colorant, and an optional retroreflecting filler; (4) subsequently developing the high areas of potential with a second developer comprising a second toner comprising a thermoplastic resin, an optional colorant, and an optional retroreflecting filler; and (5) transferring the developed images to a substrate, wherein a retroreflecting filler is necessarily present in either the first toner or the second toner, and wherein a colorant is necessarily present in a toner containing no retroreflecting filler. Another embodiment of the present invention is directed to a process which comprises incorporating into an ink jet printer an ink composition comprising a liquid vehicle, an optional colorant, and a retroreflecting filler, and causing droplets of the ink composition to be ejected in an imagewise pattern onto a substrate. Yet another embodiment of the present invention is directed to a process for generating images which comprises generating an electrostatic latent image on an imaging member in an imaging apparatus; developing the latent image with a toner comprising a thermoplastic resin and a colorant; transferring the developed image to a substrate; optionally permanently affixing the transferred image to the substrate; and causing droplets of an ink composition comprising a liquid vehicle, an optional colorant, and a retroreflecting filler to be ejected in an imagewise pattern onto the substrate. Still another embodiment of the present invention is directed to an ink composition which comprises an aqueous liquid vehicle and a retroreflective filler material, said ink composition having a viscosity of no more than about 5 centipoise. Another embodiment of the present invention is directed to a liquid developer for the development of electrostatic latent images which comprises a nonaqueous liquid vehicle, an optional charge control agent, and retroreflective filler particles, said developer having a resistivity of at least about $10^8$ and a viscosity of no more than 500 centipoise at the temperature at which development occurs. Yet another embodiment of the present invention is directed to an imaging process which comprises generating an electrostatic latent image on an imaging member and contacting the latent image with a liquid developer comprising a nonaqueous liquid vehicle, a charge control agent, and toner particles comprising retroreflective filler particles, thereby causing the toner particles to migrate through the liquid and develop the latent image. Still another embodiment of the present invention is directed to an imaging process which comprises generating an electrostatic latent image on an imaging member, applying to an applicator a liquid developer comprising a nonaqueous liquid vehicle and retroreflective filler particles, and bringing the applicator into sufficient proximity with the latent image to cause the image to attract the developer onto the imaging member, thereby developing the image. Another embodiment of the present invention is directed to an imaging process which comprises applying a liquid to a substrate in imagewise fashion, followed by applying retroreflective filler particles to the liquid image. Yet another embodiment of the present invention is directed to a process for controlling a reproduction system, comprising the steps of: (1) scanning an image to detect retroreflective filler material in at least one marking material forming the image; and (2) issuing instructions to the reproduction system, wherein the instructions cause the reproduction system to take an action selected from the group consisting of: (a) prohibiting reproduction of those portions of the image formed by marking material containing retroreflective filler material, and reproducing of all other portions of the image; (b) prohibiting reproduction of any part of the image upon detection of retroreflective filler material; (c) reproducing only those portions of the image formed by marking material containing retroreflective filler material; (d) reproducing portions of the image formed by marking material containing retroreflective filler material in a different manner from that in which the system reproduces portions of the image formed by marking material not containing retroreflective filler material; and (e) identifying a source of the image on the basis of detection of retroreflective filler material. Still another embodiment of the present invention is directed to a process for determining the relative position of a movable component in an imaging apparatus which comprises (a) providing on the movable component at least one mark with a marking material containing a retroreflective filler material; (b) positioning an illumination source so that illumination from the illumination source strikes the mark on the movable component; (c) positioning an illumination detector so that it can detect illumination reflected from the retroreflective filler material on the movable component; and (d) calculating the relative position of the movable component using information provided from the illumination detector.

DETAILED DESCRIPTION OF THE INVENTION

Figure 1:
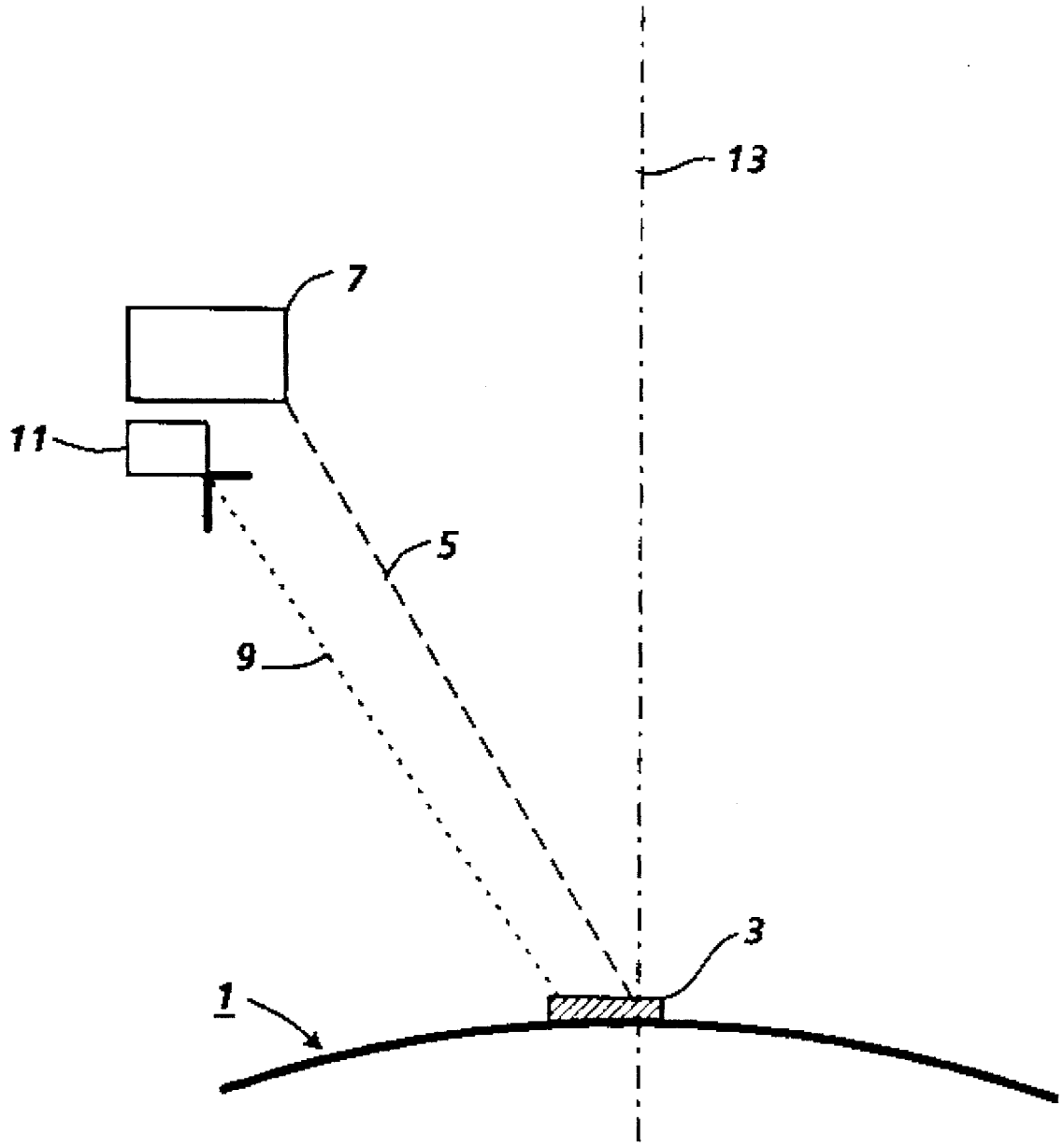
FIG. 1 illustrates schematically a substrate on which is situated a mark made with a material containing retroreflective filler material.

The present invention is directed to marking materials containing retroreflective fillers and to processes for applying the marking materials to substrates to form images. Retroreflectors are those reflectors that return the illuminating light back nearly along the direction of illumination, as illustrated schematically in FIG. 1. FIG. 1 illustrates schematically in cross-section a substrate 1 on which is situated a mark 3 made with a material containing retroreflective filler material. Incident light 5 from illumination source 7 strikes the mark 3 and is reflected back along a line 9 which is nearly colinear with the line of incident light 5. An optical detector 11, which can be either a human eye or a mechanical device, can then detect the reflected light. The angles of incident and reflected light need not be normal to the mark 3; as shown in FIG. 1, the angles of incident and reflected light are at an angle of about 30° from the normal (represented by line 13), and angles of from 0° to more than 60° from the normal are suitable for illuminating and detecting the retroreflective filler material.

Retroreflectors are commonly found in road and vehicle marking signs and hazard warnings, reflective safety clothing, radar scanners, bicycle reflectors, joggers' vests, and satellite TV dishes. Three reflecting surfaces joined at a corner form a retroreflector. Retroreflectors can be formed from corner cubes made of plastic that reflect light by internal reflection. This internal reflection can be obtained by backing the plastic against an air gap or a reflecting surface or by providing a reflecting backcoating. A glass sphere with a refractive index of about 2 is also a retroreflector. Microscopic glass beads with a diameter of about 0.1 millimeters are widely used in retroreflecting sheets and paints; the refractive index of such glass spheres is typically around 1.9. Glass with high barium and titanium oxide content is particularly suitable. If the beads are backcoated with a reflecting layer or embedded in a highly scattering matrix such at titanium oxide particles, the reflected illumination is even more efficient. Further details regarding this embodiment are disclosed in, for example, Nell Morton, *Phys. Educ.*, 1991, 26, the disclosure of which is totally incorporated herein by reference. Suitable retroreflecting glass spheres are also available from Potters Industries, Carlstadt, N.J. "Visibeads" from Potters Industries are engineered for epoxy, latex paint, polyester, and thermoplastic binders. Particularly useful are the T-4 high index glass beads with a size range of 90 to 53 microns. A line of retroreflecting liquids is also available from 3M, St. Paul, Minn., under the trade name "Scotchlite, Series 7200". These retroreflecting liquids are available in several colors and can be applied by screen printing, brushing, spraying, and dipping. These retroreflecting materials are also available from 3M coated on film under the trade name "Trimlite". In addition, retroreflecting particles can be prepared by forming small droplets of molten glass having a relatively high index of refraction, followed by cooling to form solid spheres. Ideally, the index of refraction for the glass employed is 2. The index of refraction can be as low as 1.5, but values closer to 2 are preferred. Materials with indices of refraction greater than 2 can also be employed if desired, although no additional advantages are realized by exceeding an index of refraction of 2. Submicron-sized particles can be prepared by heating air fluidized glass powder. The retroreflective filler is present in the marking material in any effective amount.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion deposition, as described, for example, in U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Typically, in a dry powder toner material of the present invention for developing electrostatic latent images, the retroreflective filler is present in the toner in an amount of from about 5 to about 90 percent by weight, more preferably from about 10 to about 80 percent by weight, and even more preferably from about 30 to about 50 percent by weight, although the amount can be outside these ranges. The retroreflective fillers can be present in the dry powder toner as an ingredient which is melt mixed with the toner resin prior to formation of toner particles. Preferably, however, a dry powder toner contains retroreflective filler particles dry blended with particles of the toner resin (which toner resin may or may not, as desired, contain a colorant, a charge control agent, or any other optional ingredients). Preferably, the average particle diameter of the retroreflective filler particles is comparable to or somewhat larger than that of the toner resin particles to enable the retroreflective filler particles to protrude from the developed image. Typical preferred particle sizes for the retroreflective filler particles are from about 0.2 to about 2 times the average particle diameter of the toner resin particles, although the size can be outside this range.

Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are present in the toner in any effective amount, typically from about 10 to 95 percent by weight, preferably from about 20 to about 90 percent by weight, and more preferably from about 50 to about 70 percent by weight, although the amount can be outside these ranges.

Optionally, if it is desired to generate images that are visible with the naked eye, the toner composition can also contain a colorant. Typically, the colorant material is a pigment, although dyes can also be employed. Examples of suitable pigments and dyes are disclosed in, for example, U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable dyes and pigments include carbon black, nigrosine dye, aniline blue, magnetites, and mixtures thereof, with carbon black being the most common colorant. The pigment should be present in an amount sufficient to render the toner composition highly colored to permit the formation of a clearly visible image on a recording member. Typically, the pigment particles are present in amounts of from about 1 percent by weight to about 20 percent by weight based on the total weight of the toner composition, although the amount can be outside this range.

When the pigment particles are magnetites, which comprise a mixture of iron oxides ($Fe_3O_4$) such as those commercially available as Mapico Black, these pigments are present in the toner composition in any effective amount, typically from about 10 percent by weight to about 70 percent by weight, and preferably from about 20 percent by weight to about 50 percent by weight, although the amount can be outside these ranges.

Colored toner pigments are also suitable for use with the present invention, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as CI 60710, CI Dispersed Red 15, a diazo dye identified in the color index as CI 26050, CI Solvent Red 19, and the like. Illustrative examples of suitable cyan pigments include copper tetra-4-(octadecyl sulfonamido) phthalocyanine, copper phthalocyanine pigment, listed in the color index as CI 74160, Pigment Blue, and Anthradanthrene Blue, identified in the color index as CI 69810, Special Blue X-2137, and the like. Illustrative examples of yellow pigments that may be selected include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L 1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are typically present in the toner an amount of from about 15 to about 20.5 percent by weight, although the amount can be outside this range.

The toner compositions of the present invention can also contain an optional charge control additive. Examples of suitable charge control agents are disclosed in U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable charge control agents include alkyl pyridinium halides, such as cetyl pyridinium chloride, as disclosed in U.S. Pat. No. 4,298,672, the disclosure of which is totally incorporated herein by reference, cetyl pyridinium tetrafluoroborates, quaternary ammonium sulfate and sulfonate compounds, such as distearyl dimethyl ammonium methyl sulfate, as disclosed in U.S. Pat. No. 4,338,390, the disclosure of which is totally incorporated herein by reference, stearyl phenethyl dimethyl ammonium tosylates, as disclosed in U.S. Pat. No. 4,338,390, distearyl dimethyl ammonium methyl sulfate, as disclosed in U.S. Pat. No. 4,560,635, the disclosure of which is totally incorporated herein by reference, distearyl dimethyl ammonium bisulfate as disclosed in U.S. Pat. No. 4,937,157 and U.S. Pat. No. 4,560,635, the disclosures of each of which are totally incorporated herein by reference, stearyl dimethyl hydrogen ammonium tosylate, charge control agents as disclosed in U.S. Pat. No. 4,294,904, the disclosure of which is totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. Additional examples of suitable charge control additives are disclosed in U.S. Pat. No. 4,560,635 and U.S. Pat. No. 4,294,904, the disclosures of each of which are totally incorporated herein by reference. Charge control agents are present in any effective amount, typically from about 0.1 to about 4 percent by weight, and more preferably from about 0.5 to about 1 percent by weight, although the amount can be outside this range.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a colored resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin (a linear polymeric alcohol comprising a fully saturated hydrocarbon backbone with at least about 80 percent of the polymeric chains terminated at one chain end with a hydroxyl group, of the general formula $CH_3(CH_2)_nCH_2OH$, wherein n is a number from about 30 to about 300, and preferably from about 30 to about 50, available from Petrolitc Chemical Company), polyethylene waxes, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners of the present invention can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer.

After transfer, the transferred toner image can be fixed to the receiving sheet. The fixing step can be also identical to that conventionally used in electrophotographic imaging.

Typical, well known electrophotographic fusing techniques include heated roll fusing, flash fusing, oven fusing, laminating, adhesive spray fixing, and the like.

When the marking material is a dry powder toner composition for developing electrostatic latent images, it may be desired to modify the surface characteristics of the retroreflective filler material to impart to it the desired triboelectric charging characteristics or conductivity. One method of modifying the surface characteristics is to react a tetraalkoxysilane with an alcoholic alkaline solution in the presence of a soluble charge enhancing additive, as disclosed in, for example, U.S. Pat. No. 4,902,598, the disclosure of which is totally incorporated herein by reference. The triboelectric characteristics can also be modified by other methods, such as by applying a thin coating of a polymer to the retroreflective particles by any suitable method, such as solution coating, or by washing the retroreflective fillers with a solution containing a charge control additive followed by drying of the particles, or the like.

In one specific embodiment of the present invention, two different images are applied to a substrate by a tri-level imaging process, wherein an electrostatic latent image comprising three different levels of potential is generated on an imaging member and two different toners of different colors are employed to develop the image in a single pass. One embodiment of the present invention is directed to an imaging process which comprises (1) charging an imaging member in an imaging apparatus; (2) creating on the member a latent image comprising areas of high, intermediate, and low potential; (3) developing the low areas of potential with a first developer comprising a first toner comprising a resin, an optional colorant, and an optional retroreflecting filler; and a first carrier; (4) subsequently developing the high areas of potential with a second developer comprising a second toner comprising a resin, an optional colorant, and an optional retroreflecting filler; and a second carrier; and (5) transferring the developed images to a substrate, wherein a retroreflecting filler is necessarily present in either the first toner or the second toner, and wherein a colorant is necessarily present in either the first toner or the second toner (and may be present in both). Tri-level imaging processes are well-known, as disclosed in, for example, U.S. Pat. No. 4,078,929, U.S. Pat. No. 4,686,163, U.S. Pat. No. 4,948,686, U.S. Pat. No. 4,903,048, U.S. Pat. No. 4,847,655, U.S. Pat. No. 4,811,046, U.S. Pat. No. 5,021,838, U.S. Pat. No. 4,833,504, U.S. Pat. No. 5,079,114, and U.S. Pat. No. 5,080,988, the disclosures of each of which are totally incorporated herein by reference.

Liquid developers and liquid development processes for the development of electrostatic latent images are also known. In electrophoretic developers and processes, the liquid developers generally comprise a liquid vehicle and colored toner particles, and frequently also contain a charge control agent. The colored toner particles become charged, and upon contacting the electrostatic latent image with the liquid developer, the particles migrate through the liquid vehicle toward the charged image, thereby effecting development. Any residual liquid vehicle remaining on the image subsequent to development is evaporated or absorbed into the receiving sheet. Typically, liquid developers employ hydrocarbon liquid vehicles, most commonly high boiling aliphatic hydrocarbons that are relatively high in resistivity and nontoxic. Developers and processes of this type are disclosed in, for example, U.S. Pat. No. 4,476,210, U.S. Pat. No. 2,877,133, U.S. Pat. No. 2,890,174, U.S. Pat. No. 2,899,335, U.S. Pat. No. 2,892,709, U.S. Pat. No. 2,913,353, U.S. Pat. No. 3,729,419, U.S. Pat. No. 3,841,893, U.S. Pat. No. 3,968,044, U.S. Pat. No. 4,794,651, U.S. Pat. No. 4,762,764, U.S. Pat. No. 4,830,945, U.S. Pat. No. 4,686,936, U.S. Pat. No. 4,766,049, U.S. Pat. No. 4,707,429, U.S. Pat. No. 4,780,388, U.S. Pat. No. 3,976,808, U.S. Pat. No. 4,877,698, U.S. Pat. No. 4,880,720, U.S. Pat. No. 4,880,432, and copending application U.S. Ser. No. 07/300,395, now U.S. Pat. No. 5,030,535, the disclosures of each of which are totally incorporated herein by reference.

In polarizable liquid development processes, as disclosed in U.S. Pat. No. 3,084,043 (Gundlach), the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, Canadian Patent 937,823, Canadian Patent 926,182, Canadian Patent 942, 554, British Patent 1,321,286, and British Patent 1,312,844, the disclosures of each of which are totally incorporated herein by reference.

The present invention also includes liquid developers for developing electrostatic latent images which contain retroreflective fillers. Liquid developers of the present invention suitable for polarizable liquid development processes can comprise a nonaqueous liquid vehicle, retroreflective fillers, and, optionally and if desired, a colorant. When the liquid developer is intended for use in a polarizable liquid development system, the liquid developer is applied to an applicator such as a gravure roll and brought near an electrostatic latent image. The charged image polarizes the liquid developer in the depressions in the applicator, thereby drawing the developer from the depressions and causing it to flow to the image bearing member to develop the image. For this application, the liquid developer is somewhat more viscous than is the situation with electrophoretic development, since particle migration within the developer is generally not necessary and since the liquid developer must be sufficiently viscous to remain in the depressions in the applicator prior to development. The viscosity, however, remains significantly lower than that typically observed for many printing inks, since the liquid developer must be capable of being pulled from the depressions in the applicator roll by the force exerted by the electrostatic latent image. Thus, liquid developers for use in polar development systems typically have a viscosity of from about 25 to about 500 centipoise at the operating temperature of the copier or printer, and preferably from about 30 to about 300 centipoise at the machine operating temperature, although the viscosity can be outside these ranges. In addition, liquid developers intended for use in polarizable liquid development systems typically have a resistivity lower than liquid developers employed in electrophoretic development systems to enable the developer to become polarized upon entering proximity with the electrostatic latent image. The liquid developers of the present invention, however, gradually have resistivities that are significantly higher than the resistivities of typical printing inks, for which resistivities generally are substantially less than about $10^9$ ohm-cm. Typically, liquid developers for polarizable liquid development systems have a resistivity of from about $10^8$ to about $10^{11}$ ohm-cm, and preferably from about $2\times10^9$ to about $10^{10}$ ohm-cm, although the resistivity can be outside these ranges.

In polarizable liquid developers of the present invention the retroreflective filler particles are present in the developer in any effective amount, typically from about 5 to about 80 percent by weight, preferably from about 30 to about 50 percent by weight, although the amount can be outside these ranges.

Typical liquid materials suitable as liquid vehicles for polarizable liquid developers include Magiesols, such as Magiesol 60, a highly refined petroleum distillate which has essentially a zero vapor pressure at ambient temperature, available from Magie Oil Company, Illinois; Witsol 50, available from Witco Inc.; Isopar V, available from Exxon Chemical; Paraflex HT-10, available from Gulf Inc. of Canada; Shellflex 210 and Shellflex 270, available from Shell Chemical Company; Parabase, available from Shell Chemical Company; mineral oil; vegetable oil, such as castor oil and its oxidized derivatives; peanut oil; coconut oil; sunflower seed oil; corn oil; rape seed oil; sesame oil; mineral spirits; fluorocaron oils, such as DuPont's Freon solvents and Krytox oils; silicone oils, kerosene; carbon tetrachloride; toluene; drying oils such as linseed oil and tung oil; highly purified polypropylene glycol; butoxytriglycol; dibutyl phthalate; and the like, as well as mixtures thereof. The liquid vehicle is present in the liquid developer in a major amount, typically from about 20 to about 99 percent by weight, preferably from about 60 to about 98 percent by weight, and available from Shell Chemical Company; and the like, as well as mixtures thereof. The polymer becomes adsorbed onto the surfaces of the retroreflective filler particles in the liquid developer and functions as a stabilizer to maintain distance between the retroreflective filler particles and prevent agglomeration and precipitation of the particles in the developer. Generally, the polymer is present in the liquid developer in an amount of from about 0.5 to about 15 percent by weight, and preferably from about 1 to about 5 percent by weight.

If desired, the liquid developer can also contain colorant particles, such as pigment particles.

The liquid developer in this embodiment generally can be prepared by heating and mixing the ingredients, followed by grinding the mixture in an attritor until homogeneity of the mixture has been achieved, generally for about one hour. Subsequently, the charge control agent is added to the mixture to yield the liquid developer. Subsequent to the preparation of this developer composition, the particles generally possess a charge to mass ratio of from about 50 to 2,000 microcoulombs per gram.

The liquid developers of this embodiment of the invention are useful in known imaging and printing processes. These liquid developers may be employed in imaging methods wherein an electrostatic latent image is formed on an imaging member, developed with the developer composition illustrated herein, transferred to a suitable substrate such as paper or transparency material, and thereafter optionally permanently affixed thereto. In addition, these liquid developers can be employed for direct printing processes, including, for example, the printing process employed by the Versatec® V-80 printer. In direct or stylus writing printing processes, a paper sheet coated with a dielectric or electrically insulating polymer coating is placed between a series of styli situated near one surface of the paper and an electrode situated near the opposite surface of the paper. Generation of an electric field between the styli and the electrode results in electrical breakdown of the air between the styli and the paper, thereby generating ions that adhere to the paper. Thus, by generating an electrical field between specific styli and the electrode in imagewise fashion, ions are deposited on the paper in imagewise fashion to form an electrostatic latent image. The paper bearing the latent image is then contacted with the liquid developer of the present invention comprising a liquid medium, retroreflective filler particles, a polymer soluble in the liquid medium, and a charge control agent, the particles in said developer having a charge opposite to that of the latent image, resulting in development of the latent image. Subsequently, the liquid medium evaporates from the paper and the particles adhere to the paper in imagewise fashion. Generally, fusing of the particles to the substrate is not necessary. Further information concerning direct or stylus writing printing processes is disclosed, for example, U.S. Pat. Nos. 2,919,171; 3,564,556; 3,693,185; 3,793,107; 3,829,185; 4,042,939; 3,729,123; 3,859,960; 3,937,177; 3,611,419; 4,569,584; 4,240,084; 4,524,371; and 4,322,469, the disclosures of each of which are totally incorporated herein by reference.

The electrophoretic liquid developers of the present invention can also include a charge control agent to help impart a charge to the colored toner particles. A charge control additive is generally present in the electrophoretic liquid developers of the present invention to impart to the particles contained in the liquid a charge sufficient to enable them to migrate through the liquid vehicle to develop an image. Examples of suitable charge control agents for liquid developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; and the like, as well as mixtures thereof. The charge control additive may be present in an amount of from about 0.001 to about 3 percent by weight, and preferably from about 0.01 to about 0.8 percent by weight of the developer composition. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. No. 4,707,429, U.S. Pat. No. 4,702,984, and U.S. Pat. No. 4,702,985, the disclosures of each of which are totally incorporated herein by reference.

In general, images are developed with the liquid electrophoretic developers and the polarizable liquid developers of the present invention by generating an electrostatic latent image and contacting the latent image with the liquid developer, thereby causing the image to be developed. When a liquid electrophoretic developer of the present invention is employed, the process entails generating an electrostatic latent image and contacting the latent image with the developer comprising a liquid vehicle and charged toner particles, thereby causing the charged particles to migrate through the liquid and develop the image. Developers and processes of this type are disclosed in, for example, U.S. Pat. No. 4,804,601, U.S. Pat. No. 4,476,210, U.S. Pat. No. 2,877,133, U.S. Pat. No. 2,890,174, U.S. Pat. No. 2,899,335, U.S. Pat. No. 2,892,709, U.S. Pat. No. 2,913,353, U.S. Pat. No. 3,729,419, U.S. Pat. No. 3,841,893, U.S. Pat. No. 3,968,044, U.S. Pat. No. 4,794,651, U.S. Pat. No. 4,762,764, U.S. Pat. No. 4,830,945, U.S. Pat. No. 3,976,808, U.S. Pat. No. 4,877,698, U.S. Pat. No. 4,880,720, U.S. Pat. No. 4,880,432, and copending application U.S. Ser. No. 07/300,395, now U.S. Pat. No. 5,030,535, the disclosures of each of which are totally incorporated herein by reference. When a liquid developer of the present invention suitable for polarizable liquid development processes is employed, the process entails generating an electrostatic latent image on an imaging member, applying the liquid developer to an applicator, and bringing the applicator into sufficient proximity with the latent image to cause the image to attract the developer onto the imaging member, thereby developing the image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, U.S. Pat. No. 4,686,936, U.S. Pat. No. 4,764,446, Canadian Patent 937,823, Canadian Patent 926, 182, Canadian Patent 942,554, British Patent 1,321,286, and British Patent 1,312,844, the disclosures of each of which are totally incorporated herein by reference. In both of these embodiments, any suitable means can be employed to generate the image. For example, a photosensitive imaging member can be exposed by incident light or by laser to generate a latent image on the member, followed by development of the image and transfer to a substrate such as paper, transparency material, cloth, or the like. In addition, an image can be generated on a dielectric imaging member by electrographic or ionographic processes as disclosed, for example, in U.S. Pat. No. 3,564,556, U.S. Pat. No. 3,611, 419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, U.S. Pat. No. 4,485,982, U.S. Pat. No. 4,731,622, U.S. Pat. No. 3,701,464, and U.S. Pat. No. 4,155,093, the disclosures of each of which are totally incorporated herein by reference, followed by development of the image and, if desired, transfer to a substrate. If necessary, transferred images can be fused to the substrate by any suitable means, such as by heat, pressure, exposure to solvent vapor or to sensitizing radiation such as ultraviolet light or the like as well as combinations thereof. Further, the liquid developers of the present invention can be employed to develop electrographic images wherein an electrostatic image is generated directly onto a substrate by electrographic or ionographic processes and then developed, with no subsequent transfer of the developed image to an additional substrate.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Drop-on-demand systems require no ink recovery, charging, or deflection. There are two types of drop-on-demand ink jet systems. One type of drop-on-demand system has as its major components an ink filled channel or passageway having a nozzle on one end and a transducer, which can be mechanical, piezoelectric, or the like, near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops and the bubble collapses, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands as the excess heat is used to convert liquid to vapor, which removes heat due to heat of vaporization or diffuses away. The expansion of the bubble forces a droplet of ink out of the nozzle. Once the excess heat is lost, the bubble collapses on the resistor. At this point, the resistor is no longer being heated because the current pulse has passed and the droplet is propelled at a high rate of speed towards the recording medium. This entire bubble formation and collapse sequence occurs in about 10 microseconds. Subsequently, the ink channel refills by capillary action. This typically is not retired for about 100 to 500 microseconds minimum dwell time to enable the channel to refill and to enable the ink motion to dampen. Thermal ink jet processes are well known and are described in, for example, U.S. Pat. No. 4,601,777, U.S. Pat. No. 4,251,824, U.S. Pat. No.

4,410,899, U.S. Pat. No. 4,412,224, and U.S. Pat. No. 4,532,530, the disclosures of each of which are totally incorporated herein by reference.

In a liquid ink composition such as an aqueous ink jet ink, the retroreflective filler typically is present in the ink in an amount of from about 1 to about 20 percent by weight, and preferably from about 4 to about 8 percent by weight, although the amount can be outside these ranges.

Aqueous ink compositions, such as those suitable for use in ink jet printing, particularly thermal ink jet printing, generally contain a humectant in addition to water as the liquid vehicle. The humectant typically is an organic material miscible with water. Examples of suitable humectants include ethylene glycol, propylene glycol, diethylene glycols, glycerine, dipropylene glycols, polyethylene glycols, polypropylene glycols, amides, urea, substituted ureas, ethers, carboxylic acids, esters, alcohols, organosulfides, organosulfoxides, sulfones (such as sulfolane), alcohol derivatives, carbitol, butyl carbitol, cellusolve, ether derivatives, amino alcohols, ketones, N-methylpyrrolidinone, 2-pyrrolidinone, cyclohexylpyrrolidone, hydroxyethers, amides, sulfoxides, lactones, and other water miscible materials, as well as mixtures thereof. The humectant can be present in the ink composition in any effective amount. Typically, the the water to organic ratio is from about 100:0 to about 30:70, preferably from about 97:3 to about 50:50, although the ratio can be outside this range.

Optionally, if it is desired to generate images that are visible with the naked eye, the ink composition can also contain a colorant. The colorant for the inks of the present invention can be a dye. Examples of suitable dyes are disclosed in, for example, U.S. Pat. No. 4,877,451, U.S. Pat. No. 5,017,644, and U.S. Pat. No. 5,019,166, the disclosures of each of which are incorporated herein by reference. Specific examples of suitable dyes include anthraquinones, monoazo dyes, disazo dyes, phthalocyanines, aza[18]annulenes, formazan copper complexes, triphenodioxazines, Bernacid Red 2BMN; Pontamine Brilliant Bond Blue A; Pontamine; Food Black 2; Carodirect Turquoise FBL Supra Conc. (Direct Blue 199), available from Carolina Color and Chemical; Special Fast Turquoise 8GL Liquid (Direct Blue 86), available from Mobay Chemical; Intrabond Liquid Turquoise GLL (Direct Blue 86), available from Crompton and Knowles; Cibracron Brilliant Red 38-A (Reactive Red 4), available from Aldrich Chemical; Drimarene Brilliant Red X-2B (Reactive Red 56), available from Pylam, Inc.; Levafix Brilliant Red E-4B, available from Mobay Chemical; Levafix Brilliant Red E-6BA, available from Mobay Chemical; Procion Red H8B (Reactive Red 31), available from ICI America; Pylam Certified D&C Red #28 (Acid Red 92), available from Pylam; Direct Brill Pink B Ground Crude, available from Crompton & Knowles; Cartasol Yellow GTF Presscake, available from Sandoz, Inc.; Tartrazine Extra Conc. (FD&C Yellow #5, Acid Yellow 23), available from Sandoz; Carodirect Yellow RL (Direct Yellow 86), available from Carolina Color and Chemical; Cartasol Yellow GTF Liquid Special 110, available from Sandoz, Inc.; D&C Yellow #10 (Acid Yellow 3), available from Tricon; Yellow Shade 16948, available from Tricon, Basacid Black X34, available from BASF, Carta Black 2GT, available from Sandoz, Inc.; Direct Brilliant Pink B (Crompton-Knolls); Aizen Spilon Red C-BH (Hodagaya Chemical Company); Kayanol Red 3BL (Nippon Kayaku Company); Levanol Brilliant Red 3BW (Mobay Chemical Company); Levaderm Lemon Yellow (Mobay Chemical Company); Spirit Fast Yellow 3G; Sirius Supra Yellow GD 167; Cartasol Brilliant Yellow 4GF (Sandoz); Pergasol Yellow CGP (Ciba-Geigy); Dermacarbon 2GT (Sandoz); Pyrazol Black BG (ICI); Morfast Black Conc A (Morton-Thiokol); Diazol Black RN Quad (ICI); Luxol Blue MBSN (Morton-Thiokol); Sevron Blue 5GMF (ICI); Basacid Blue 750 (BASF); Bernacid Red, available from Berncolors, Poughkeepsie, N.Y.; Pontamine Brilliant Bond Blue; Berncolor A. Y. 34; Telon Fast Yellow 4GL-175; BASF Basacid Black SE 0228; the Pro-Jet series of dyes available from ICI, including Pro-Jet Yellow I (Direct Yellow 86), Pro-Jet Magenta I (Acid Red 249), Pro-Jet Cyan I (Direct Blue 199), Pro-Jet Black I (Direct Black 168), Pro-Jet Yellow 1-G (Direct Yellow 132), Aminyl Brilliant Red F-B, available from Sumitomo Chemical Co. (Japan), the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Brilliant Yellow GL-SF VP220 (Reactive Yellow 37), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Direct Turquoise Blue FRL-SF VP368 (Direct Blue 199), Duasyn Acid Blue AESF VP344 (Acid Blue 9), and the like, as well as mixtures thereof. The dye is present in any effective amount, typically from about 1 to about 20 percent by weight, and preferably from about 2 to about 6 percent by weight, although the amount can be outside these ranges.

In addition, the optional colorant for the ink compositions of the present invention can be a pigment, or a mixture of one or more dyes and/or one or more pigments. The pigment can be black, cyan, magenta, yellow, red, blue, green, brown, mixtures thereof, and the like. Specific examples of suitable black pigments include various carbon blacks such as channel black, furnace black, lamp black, and the like. Colored pigments include red, green, blue, brown, magenta, cyan, and yellow particles, as well as mixtures thereof. Illustrative examples of magenta pigments include 2,9-dimethyl-substituted quinacridone and anthraquinone dye, identified in the Color Index as CI 60710, CI Dispersed Red 15, a diazo dye identified in the Color Index as CI 26050, CI Solvent Red 19, and the like. Illustrative examples of suitable cyan pigments include copper tetra-4-(octadecyl sulfonamido) phthalocyanine, X-copper phthalocyanine pigment, listed in the color index as CI 74160, CI Pigment Blue, and Anthradanthrene Blue, identified in the Color Index as CI 69810, Special Blue X-2137, and the like. Illustrative examples of yellow pigments that can be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Additional examples of pigments include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Additional suitable commercially available pigment dispersions include the Hostafines available from Hoechst, including Hostafine Black T, Hostafine Black TS, Hostafine Yellow HR, Hostafine Yellow GR, Hostafine Red FRLL, Hostafine Rubine F6B, and Hostafine Blue B2G, as well as dispersions available from BASF, including Disperse Black 00-6607, Luconyl Yellow 1250, Basoflex Pink 4810, Luconyl Blue 7050, and the like. Other pigments can also be selected. Preferably, the pigment particle size is as small as possible to enable a stable colloidal suspension of the particles in the liquid vehicle and to prevent clogging of the ink channels when the ink is used in a thermal ink jet printer. Preferred particle average diameters are generally from about 0.001 to about 5 microns, and more preferably from about 0.1 to about 1 microns, although the particle size can be outside these ranges. The pigment is present in the ink composition in any effective amount, typically from about 1 to about 20 percent by weight and preferably from about 4 to about 8 percent by weight, although the amount can be outside these ranges.

Other additives can also be present in the inks. For example, one or more surfactants or wetting agents can be added to the ink. These additives may be of the cationic, anionic, or nonionic types. Suitable surfactants and wetting agents include sodium lauryl sulfate, Tamol® SN, Tamoi® LG, those of the Triton® series available from Rohm and Haas Company, those of the Marasperse® series, those of the Igepal® series available from GAF Company, those of the Tergitol® series, and other commercially available surfactants. These surfactants and wetting agents are present in effective amounts, generally from 0 to about 15 percent by weight, and preferably from about 0.01 to about 8 percent by weight, although the amount can be outside of this range.

Polymeric additives can also be added to the inks to enhance the viscosity and the stability of the ink. Water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, and the like are typical polymeric additives. Polymeric additives can be present in the ink of the present invention in amounts of from 0 to about 10 percent by weight, and preferably from about 0.01 to about 5 percent by weight, although the amount can be outside this range.

One example of an additive to the inks is a polymeric additive consisting of two polyalkylene oxide chains bound to a central bisphenol-A-type moiety. This additive is of the formula

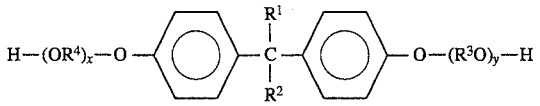

wherein $R^1$ and $R^2$ are independently selected from the group consisting of hydrogen, alkyl groups with from 1 to about 8 carbon atoms, such as methyl, ethyl, propyl, and the like, and alkoxy groups with from 1 to about 8 carbon atoms, such as methoxy, ethoxy, butoxy, and the like, $R^3$ and $R^4$ are independently selected from the group consisting of alkyl groups with from 1 to about 4 carbon atoms, and x and y are each independently a number of from about 100 to about 400, and preferably from about 100 to about 200. Generally, the molecular weight of the polyalkylene oxide polymer is from about 14,000 to about 22,000, and preferably from about 15,000 to about 20,000, although the molecular weight can be outside this range. Materials of this formula are commercially available; for example, Carbowax M20, a polyethylene oxide/bisphenol-A polymer of the above formula with a molecular weight of about 18,000, available from Union Carbide Corporation, Danbury, Conn., is a suitable polymeric additive for the inks of the present invention. In addition, compounds of the above formula can be prepared by the methods disclosed in *Polyethers,* N. G. Gaylord, John Wiley & Sons, New York (1963) and "Laboratory Synthesis of Polyethylene Glycol Derivatives," J. M. Harris, *J. Molecular Science—Rev. Macromol. Chem. Phys.,* C25(3), 325–373 (1985), the disclosures of each of which are totally incorporated herein by reference. The polyalkylene oxide additive is generally present in the ink in an amount of at least about 1 part per million. Typically, the polyalkylene oxide additive is present in amounts of up to 1 percent by weight of the ink, and preferably in amounts of up to 0.5 percent by weight of the ink; larger amounts of the additive may increase the viscosity of the ink beyond the desired level, but larger amounts can be used in applications wherein increased ink viscosity is not a problem. Inks containing these additives are disclosed in U.S. Pat. No. 5,207,825, the disclosure of which is totally incorporated herein by reference.

Other optional additives to the inks include biocides such as Dowicil 150, 200, and 75, benzoate salts, sorbate salts, and the like, present in an amount of from about 0.0001 to about 4 percent by weight, and preferably from about 0.01 to about 2.0 percent by weight, pH controlling agents such as acids or, bases, phosphate salts, carboxylates salts, sulfite salts, amine salts, and the like, present in an amount of from 0 to about 1 percent by weight and preferably from about 0.01 to about 1 percent by weight, or the like.

For thermal ink jet printing applications, the ink compositions are generally of a viscosity suitable for use in thermal ink jet printing processes. Typically, the ink viscosity is no more than about 5 centipoise, and preferably is from about 1 to about 2.5 centipoise, although the viscosity can be outside this range. Inks suitable for piezoelectric drop-on-demand printing or continuous stream printing can also be prepared containing retroreflective fillers according to the present invention.

Ink compositions suitable for ink jet printing can be prepared by any suitable process. Typically, the inks are prepared by simple mixing of the ingredients. One process entails mixing all of the ink ingredients together and filtering the mixture to obtain an ink. Inks can be prepared by preparing a conventional ink composition according to any desired process, such as by mixing the ingredients, heating if desired, and filtering, followed by adding any desired additional additives to the mixture and mixing at room temperature with moderate shaking until a homogeneous mixture is obtained, typically from about 5 to about 10 minutes. Alternatively, the optional ink additives can be mixed with the other ink ingredients during the ink preparation process, which takes place according to any desired procedure, such as by mixing all the ingredients, heating if desired, and filtering.

The present invention is also directed to a process which entails incorporating an ink composition prepared by the process of the present invention into an ink jet printing apparatus and causing droplets of the ink composition to be ejected in an imagewise pattern onto a substrate. In a particularly preferred embodiment, the printing apparatus employs a thermal ink jet process wherein the ink in the nozzles is selectively heated in an imagewise pattern, thereby causing droplets of the ink to be ejected in imagewise pattern. Any suitable substrate can be employed, including plain papers such as Xerox® 4024 papers, ruled notebook paper, bond paper, silica coated papers such as Sharp Company silica coated paper, JuJo paper, and the like, transparency materials, fabrics, textile products, plastics, polymeric films, inorganic substrates such as metals and wood, and the like. In a preferred embodiment, the process entails printing onto a porous or ink absorbent substrate, such as plain paper.

In yet another embodiment of the present invention, the retroreflective filler particles are applied in imagewise fashion to a substrate by a strip-out process. More specifically, this process entails applying a liquid to a substrate in imagewise fashion, followed by applying retroreflective filler particles to the liquid image. In a preferred embodiment, the liquid is curable and is cured to a solid subsequent to application of the retroreflective filler particles to the liquid. More specifically, this preferred embodiment entails applying a curable liquid to a first substrate in an image pattern, optionally transferring the curable liquid image to a second substrate, subsequently contacting the curable liquid image with retroreflective filler particles so that the retroreflective filler particles adhere to the curable liquid image, optionally transferring the curable liquid and the retroreflective filler particles in image pattern to a third substrate, and curing the curable liquid in the image pattern to a solid.

Further general information regarding strip-out development processes, and specifically those processes employing a curable liquid, are disclosed in copending application U.S. Ser. No. 07/971,742, filed Nov. 5, 1992, now U.S. Pat. No. 5,397,673, entitled "Curable Strip-Out Development Processes," with the named inventors P. Keith Watson and Ian D. Morrison, the disclosure of which is totally incorporated herein by reference.

In strip-out development processes wherein a non-curable liquid is used, the liquid is generally selected to be compatible with the method of applying the image to the substrate. For example, if the liquid image is applied with an ink jet printer, the liquid selected must be capable of generating images of the desired quality when used in the selected printer. The liquid image is then developed by application of solid developer material thereto. The developed image can be affixed permanently to the substrate by any suitable method. For example, if an electrophotographic dry powder toner is applied to the image, the powder image can be fused by any method compatible with the selected toner, such as application of heat, pressure, solvent vapors, combinations thereof, or the like. In addition, the liquid may contain a polymer dissolved therein, so that subsequent to development with the solid particulate material, the liquid is evaporated and the polymer remains and affixes the particulate material to the substrate.

The liquid can be applied in imagewise pattern by any suitable method. For example, the liquid can be applied to the substrate by a polarizable liquid development process, wherein the liquid is applied to an applicator such as a gravure roll and brought near an electrostatic latent image. When a liquid suitable for polarizable liquid development processes is employed, the process entails generating an electrostatic latent image on an imaging member, applying the liquid to an applicator, and bringing the applicator into sufficient proximity with the latent image to cause the image to attract the liquid onto the imaging member, thereby developing the image. Processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, U.S. Pat. No. 4,686,936, U.S. Pat. No. 4,764,446, Canadian Patent 937,823, Canadian Patent 926,182, Canadian Patent 942,554, British Patent 1,321,286, and British Patent 1,312,844, the disclosures of each of which are totally incorporated herein by reference. Any suitable means can be employed to generate the image. For example, a photosensitive imaging member can be exposed by incident light or by laser to generate a latent image on the member, followed by development of the image. In addition, an image can be generated on a dielectric imaging member by electrographic or ionographic processes.

The charged image polarizes the liquid in the depressions in the applicator, thereby drawing the liquid from the depressions and causing it to flow to the image bearing member to develop the image. For this application, the liquid is sufficiently viscous to remain in the depressions in the applicator prior to development. The viscosity, however, remains significantly lower than that typically observed for many printing inks, since the liquid must be capable of being pulled from the depressions in the applicator roll by the force exerted by the electrostatic latent image. Thus, liquids for use in polar development systems typically have a viscosity of from about 25 to about 500 centipoise at the operating temperature of the copier or printer, and preferably from about 30 to about 300 centipoise at the machine operating temperature. In addition, liquids intended for use in polarizable liquid development systems typically have a resistivity that enables the liquid to become polarized upon entering proximity with the electrostatic latent image. These resistivities, however, generally are significantly higher than the resistivities of typical printing inks, for which resistivities generally are substantially less than about $10^9$ ohm-cm. Typically, liquids for polarizable liquid development systems have a resistivity of from about $10^8$ to about $10^{11}$ ohm-cm, and preferably from about $2\times10^9$ to about $10^{10}$ ohm-cm. When the liquid is applied in imagewise fashion by a polarizable liquid development process, the image thus formed typically is then transferred from the imaging member bearing the electrostatic latent image (i.e., the first substrate) to a final substrate, such as paper, transparency material, cloth, or the like. The retroreflective filler particles can be applied to the liquid image either before or after transfer from the imaging member (first substrate) to the final substrate. Similarly, when curable liquids are employed, the liquid can be cured either before or after transfer from the imaging member (first substrate) to the final substrate. When the electrostatic latent image is formed directly on a paper, such as in electrographic or ionographic processes as disclosed in, for example, U.S. Pat. No. 4,731,622, U.S. Pat. No. 4,485,982, U.S. Pat. No. 4,569,584, U.S. Pat. No. 3,611,419, U.S. Pat. No. 4,240,084, U.S. Pat. No. 3,564,556, U.S. Pat. No. 3,937,177, U.S. Pat. No. 3,729,123, U.S. Pat. No. 3,859,960, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the image generally is not transferred to an additional substrate, and the retroreflective filler particles are usually applied directly to the liquid on the paper bearing the electrostatic latent image, followed by curing of the liquid to form solid images on the paper when the liquid is curable.

In addition, the liquid can be applied to a substrate imagewise by ink jet printing processes. Liquids suitable for use with ink jet printing methods generally have physical properties similar to those preferred for the inks conventionally employed in these processes. Preferred properties for continuous stream ink jet inks include a surface tension of greater than about 35 milliNewtons per meter ($mN.m^{-1}$), a conductivity of greater than about $10^{-3}$ $(ohm\text{-}cm)^{-1}$, and a viscosity of from about 1 to about 2 milliNewton-seconds per square meter ($mN.s.m^{-2}$) at the temperature at which printing occurs. Preferred properties for drop-on-demand ink jet inks include a surface tension of greater than about 35 $mN.m^{-1}$ and a viscosity of from about 1 to about 10 $mN.s.m^{-2}$ at the temperature at which printing occurs. Inks for thermal drop-on-demand ink jet devices preferably also contain a sufficient amount of water or another volatile liquid to enable generation of a bubble upon heating of the ink.

The liquid can also be applied to the substrate by any other suitable method, such as gravure printing, letterpress, flexography, lithography, stylus writing (wherein the liquid is contained in a transfer element such as a ribbon and impact printing transfers the liquid from the element to the substrate), or the like.

When a curable liquid is employed in this embodiment of the present invention, the curable liquid can be any liquid suitable for the method selected for applying the liquid to the substrate in an image pattern and capable of being converted from a liquid to a solid. Typical liquids suitable as the curable liquid for the present invention include ethylenically unsaturated compounds, including monomers, dimers, or oligomers having one or more ethylenically unsaturated groups such as vinyl or allyl groups, and polymers having terminal or pendant ethylenic unsaturation. Examples of curable liquids suitable for present invention include, but are not limited to, acrylate and methacrylate monomers or polymers containing acrylic or methacrylic group(s) of the general structure

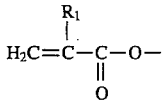

wherein $R_1$ is H or $CH_3$. The active group can be attached to an aliphatic or aromatic group with from 1 to about 20 carbon atoms and preferably from about 8 to about 12 carbon atoms, to an aliphatic or aromatic siloxane chain or ring with from 1 to about 20 dimethyl siloxane units, to a combination of the aforementioned groups, or to a polymer chain. Examples of such compounds include n-dodecyl acrylate, n-lauryl acrylate, methacryloxypropylpenta-methyldisiloxane, methylbis(trimethylsiloxy)silylpropylglycerolmethacrylate, bis(methacryloxybutyl)tetramethyldisiloxane, 2-phenoxyethyl acrylate, polyethylene glycol diacrylate, ethyoxylated bisphenol A diacrylate, pentaerythritol triacrylate, poly(acryloxypropylmethyl)siloxane, methacrylate terminated polystyrene, polybutyldiene diacrylate, and the like. Further examples of curable liquids believed to be suitable for the present invention include acrylic and methacrylic esters of polyhydric alcohols such as trimethylolpropane, pentaerythritol, and the like, and acrylate or methacrylate terminated epoxy resins, acrylate or methacrylate terminated polyesters, and the like. Another polymerizable material is the reaction product of epoxidized soy bean oil and acrylic or methacrylic acid as described in U.S. Pat. No. 4,215,167, the disclosure of which is totally incorporated herein by reference, as well as the urethane and amine derivatives described therein. Additional examples of radiation curable substances include acrylate prepolymers derived from the partial reaction of pentaerythritol with acrylic acid or acrylic acid esters, including those available from Richardson Company, Melrose Park, Ill. Further, isocyanate modified acrylate, methacrylate and itaconic acid esters of polyhydric alcohols as disclosed in U.S. Pat. No. 3,783,151, U.S. Pat. No. 3,759,809, and U.S. Pat. No. 3,825,479, the disclosures of each of which are totally incorporated herein by reference, are believed to be suitable. Radiation curable compositions based on these isocyanate modified esters including reactive diluents such as tetraethylene glycol diacrylate as well as photoinitiators and amine photoinitiation synergists are commercially available from Sun Chemical Corporation under the trade name of Suncure. Also believed to be suitable are mixtures of pentaerythritol acrylate and halogenated aromatic, alicyclic, or aliphatic photoinitiators as described in U.S. Pat. No. 3,661,614, the disclosure of which is totally incorporated herein by reference, as well as other halogenated resins that can be crosslinked by ultraviolet radiation. Additionally, materials believed to be suitable are disclosed in U.S. Pat. No. 4,399,209, the disclosure of which is totally incorporated herein by reference.

Also suitable are epoxy monomers or epoxy containing polymers having one or a plurality of epoxy functional groups, such as those resins which result from the reaction of bisphenol A (4,4'-isopropylidenediphenol) and epichlorohydrin, or by the reaction of low molecular weight phenolformaldehyde resins (Novolak resins) with epichlorohydrin, alone or in combination with an epoxy containing compound as a reactive diluent. Reactive diluents such as phenyl glycidyl ether, 4-vinylcyciohexene dioxide, limonene dioxide, 1,2-cyclohexane oxide, glycidyl acrylate, glycidyl methacrylate, styrene oxide, allyl glycidyl ether, and the like may be used as viscosity modifying agents. In addition, the range of these compounds can be extended to include polymeric materials containing terminal or pendant epoxy groups. Examples of these compounds are vinyl copolymers containing glycidyl acrylate or methacrylate as one of the comonomers. Other classes of epoxy containing polymers amenable to cure using the above catalysts are epoxy-siloxane resins, epoxy-polyurethanes, and epoxy-polyesters. Further examples of suitable epoxy resins are described in *Encyclopedia of Polymer Science and Technology,* 2nd edition, Wiley Interscience, New York, pages 322 to 382 (1986), *Methoden Der Organischen Chemie.,* Vol. E20 part 3, Georg Thiame Verlag Stuttgart, New York, pages 1891 to 1994 (1987), Crivello, J. V. et al., *Journal of Polymer Science Part A: Polymer Chemistry,* 1990, 28, pages 479 to 503, and in Crivello, J. V. et al., *Chemistry of Materials,* 1989, 1, pages 445 to 451, the disclosures of each of which are totally incorporated herein by reference, epoxidized natural oils, such as epoxidized soybean oil, epoxidized linseed oil, epoxidized safflower oil, epoxidized corn oil, epoxidized cottonseed oil, epoxidized peanut oil, and the like, and epoxidized alkyl esters of oleic tall oil fatty acids (epoxytallates or epoxytofates).

Further examples of suitable curable materials include vinyl ether monomers, oligomers, or polymers containing vinyl ether groups of the general formula $$CHR_1{=}CR_2{-}O{-}$$

where $R_1$ and $R_2$ are hydrogen or alkyl groups with from 1 to about 10 carbon atoms, and preferably from 1 to 2 carbon atoms. Examples of such materials include decyl vinyl ether, dodecyl vinyl ether, hexadecyl vinyl ether, 4-chlorobutylvinyl ether, cyclohexyl vinyl ether, 1,4-cyclohexane dimethanol divinyl ether, diethylene glycol divinyl ether, butanediol divinyl ether, hexanediol divinyl ether, octanediol divinyl ether, decanediol divinyl ether. Further examples of vinyl ether monomers and polymers are shown in "Synthesis, Characterization, and Properties of Novel Aromatic Bispropenyl Ether" by J. V. Criveilo and D. A. Conlon, *Journal of Polymer Science: Polymer Chemistry Edition,* Vol. 22, 2105–2121 (1984), "Aromatic Bisvinyl Ethers: A New Class of Highly Reactive Thermosetting Monomers" by J. V. Crivello and D.A. Conlon, *Journal of Polymer Science: Polymer Chemistry Edition,* Vol. 21, 1785–1799 (1983), "Vinyloxy-Functional Organopolysiloxane Compositions," by J. V. Crivello and R. P. Eckberg, U.S. Pat. No. 4,617,238, "Carbocationic Polymerization of Vinyl Ethers" by T. Higashimura, M. Sawamoto in *Comprehensive Polymer Science,* Vol. (3), pages 673 to 696 (1989), "Polymerisation von Vinylethern" by J. Reiners in *Methoden Der Organischen Chemie,* Vol. E20 part 2, Georg Thiame Verlag Stuttgart, New York, pages 1071–1115 (1987), the disclosures of each of which are totally incorporated herein by reference. Cyclic vinyl ethers with the following basic structure

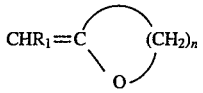

wherein $R_1$ is hydrogen or an alkyl group with from 1 to about 20 carbon atoms, and preferably from 1 to about 4 carbon atoms, and n=2 to about 20 and preferably from 3 to 8, are also useful, such as 4-phenyl-2-methylenetetrahydrofuran, 2-methylene-3,4-benzotetrahydrofuran, 2,2'-diphenyl-4-methylene-1,3-dioxolane, 2-methyl-2-phenyl-4-methylene- 1,3-dioxolane and the like. Further examples can be found in "Ring-Opening Polymerization" by W. J. Bailey in *Comprehensive Polymer Science,* Vol. (3), pages 283 to 320, Pergamon Press (1989), the disclosure of which is totally incorporated herein by reference.

Also suitable are styrene and indene monomers or oligomers, and polymers containing styrenic or indenic groups of the general formula

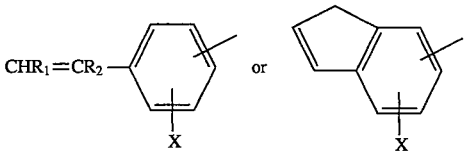

where $R_1$ and $R_2$ are H, alkyl, or aromatic groups, X is an electron donating group such as alkyl, alkoxy, N, N-dialkylamine groups and the like. The styrenic and indenic groups shown above can be attached to a polymer chain. Examples of such materials include butyl-styrene, p-ethoxy styrene, p-butoxy styrene, p-octoxy styrene, o-allyloxystyrene, divinyl benzene, 1,4-bis(p-vinylbenzeneoxy) butane, 1,8-bis(p-vinylbenzeneoxy)octane, and the like. Further examples of styrene and indene monomers are disclosed in *Vinyl and Related Polymers,* by C. E. Schildknecht, Wiley and Sons, 1952, chapters 1, 2, and 3, and *Cationic Polymerization of Olefins: A Critical Inventory,* by J. P. Kennedy, Wiley and Sons, 1975, pages 228–330, the disclosures of each of which are totally incorporated herein by reference.

Also suitable are natural occurring unsaturated oils such as linseed oil, tung oil, oiticica oil, castor oil, fish oils, soybean oil, coconut oil, cottonseed oil, and the like. Natural occurring unsaturated resins are also suitable, such as manila resin, dammar resins, Congo and Kauri resins, Ester gum (glyceryl ester of rosin), phenolic resins, and the like. Further examples of naturally occurring materials of this type are disclosed in, for example, "Encyclopedia of Polymer Science and Engineering," "Coatings" volume 3, pages 615 to 675, by J. H. Lowell (1985), "Drying Oil" volume 5, pages 203 to 214, by Z. W. Wicks, Jr. (1986), and "Polymers from Renewable Sources" volume 12, pages 678 to 682, by L. H. Sperling and C. E. Carraher (1988) (Wiley & Sons), the disclosures of each of which are totally incorporated herein by reference.

In addition, vinyl acetal and ketene acetal monomers of the following general formulae are suitable

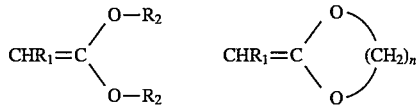

(I) (II)

wherein $R_1$ is hydrogen or alkyl or aromatic groups with from 1 to about 20 carbon atoms, and preferably from 1 to about 6 carbon atoms, and $R_2$ and $R_3$ are alkyl or aromatic groups with from 1 to about 20 carbon atoms, and preferably from 1 to about 6 carbon atoms, n=2 to 20 and preferably from 3 to 8 as in the case of cyclic vinyl acetal (II). Typical examples include diethyl ketene acetal, di-butyl ketene acetal, diphenyl ketene acetal, 2-methylene-1,3-dioxepane, 4-phenyl-2-methylene-1,3-dioxepane, 4,6-dimethyl-2-methylene-1,3-dioxane, 2-methylene-1,3-dioxe-5-pene, 4-vinyl-2-methylene-1,3-dioxzlane, and the like. Further examples are disclosed in "Ring-Opening Polymerization" by W. J. Bailey in *Comprehensive Polymer Science,* Vol. 3, pages 283 to 320, Pergamon Press (1989), the disclosure of which is totally incorporated herein by reference.

Further, linear or branched aliphatic α-olefins, such as 1-dodecene, 5-methyl-1-heptene, 2,5-dimethyl-1,5-hexadiene, and the like, alicyclic olefins and diolefins, such as d-limonene, 1,4-dimethylenecyclohexane, 1-methylene-4-vinylcyclohexane, and the like, conjugated polyenes, such as 2-phenyl-1,3-butadiene, myrcene, allocimene, 1-vinylcyclohexene, ethylbenzofulvene, and the like, bicyclic olefins, such as α-pinene, β-pinene, 2-methylene-norbornane, and the like are all suitable carrier liquids. Further examples of these classes of olefins are disclosed in *Cationic Polymerization of Olefins: A Critical Inventory,* by J. P. Kennedy, Wiley and Sons, pages 1 to 228 (1975), the disclosure of which is totally incorporated herein by reference.

Liquid 1,2-polybutadiene resins of the formulae

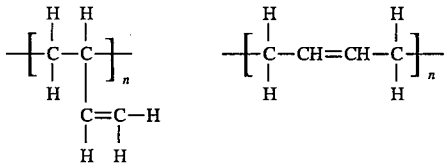

with a molecular weight between about 200 and about 3000, and preferably between about 200 and 1000, are also suitable. Thiol compounds are generally present as the comonomers with the olefin monomers. Typical examples include trithiol trimethylolethane tris(β-mercaptopropionate), tetrathiol pentaerythritol tetrakis(thiogylcolate), dimonene dimercaptane, and the like.

Other curable liquid materials include those that contain moieties such as cinnamic groups of the formula

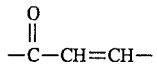

fumaric or maleic groups of the formula

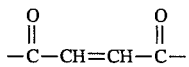

maleimido groups of the formula

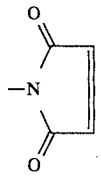

These functional groups can be present within either a monomer or a polymer comprising the liquid.

Specific examples include citrial, cinnamyl acetate, cinnamaldehyde, 4-vinylphenyl cinnamates, 4-vinylphenyl cinnamate, 4-nitrocinnamate, 4-isopropenylphenyl cinnamate, poly[1-(cinnamoyloxymethylphenyl)ethylene], poly[1-(cinnamoyloxymethylphenyl)ethylene-co-1-[(4-nitrophenoxy)methylphenyl]ethylene], 3-(2-furyl)acrolein), fumaric acid diethylester, fumaric acid dihexylester, maleic acid dibutylester, maleic acid diphenyl ester, N-phenyl maleimide, N-(4-butylphenyl) maleimide, m-phenylenediamine bis(maleimide), and N,N'-1,3 phenylenedimaleimide, and polyfunctional maleimide polymer MP-2000 from Kennedy and Klim, Little Silver, N.J.

In addition, monomers, dimers, or oligomers containing a multiplicity of one or more suitable functional groups can also be employed as the curable liquid.

Optionally, the curable liquid can contain a crosslinking agent. Crosslinking agents generally are monomers, dimers, or oligomers containing a multiplicity of functional groups, such as two styrene functionalities, a styrene functionality and an acrylate functionality, or the like. The curable liquid can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristics, faster curing, and improved adhesion of the cured image to the substrate. When present, the crosslinking agent is present in an effective amount, typically from about 1 to about 95 percent by weight of the curable liquid and preferably from about 10 to about 50 percent by weight of the curable liquid.

Additional examples of curable liquids include those materials disclosed in, for example, U.S. Pat. No. 3,989,644, U.S. Pat. No. 4,264,703, U.S. Pat. No. 4,840,977, and U.S. Pat. No. 4,933,377, the disclosures of each of which are totally incorporated herein by reference.

The curable liquids for the present invention can also contain an initiator to initiate curing of the liquid. The initiator can be added before or after formation of the image. Any suitable initiator can be employed provided that the objectives of the present invention are achieved; examples of the types of initiators suitable include thermal initiators, radiation sensitive initiators such as ultraviolet initiators, infrared initiators, visible light initiators, or the like, initiators sensitive to electron beam radiation, ion beam radiation, gamma radiation, or the like. In addition, combinations of initiators from one or more classes of initiators can be employed. Radical photoinitiators and radical thermal initiators are well known, as is electron beam curing; these materials and processes are disclosed in, for example, "Radiation Curing of Coatings," G. A. Senich and R. E. Florin, *Journal of Macromolecular Science Review. Macromol. Chem. Phys.*, C24(2), 239–324 (1984), the disclosure of which is totally incorporated herein by reference. Examples of initiators include those that generate radicals by direct photofragmentation, including benzoin ethers such as benzoin isobutyl ether, benzoin isopropyl ether, benzoin methyl ether and the like, acetophenone derivatives such as 2,2-dimethoxy-2-phenylacetophenone, dimethoxyacetophenone, 4-(2hydroxyethoxy)phenyl-(2-propyl)ketone, 2-hydroxy-2-methyl-1-phenylpropan-1-one, 2,2,2-trichloroacetophenone, 2,4,6-trimethylbenzoyldiphenylphospine oxide, and the like; initiators that form radicals by bimolecular hydrogen transfer, such as the photoexcited triplet state of diphenyl ketone or benzophenone, diphenoxybenzophenone, bis(N,N-dimethylphenyl) ketone or Michler's ketone, anthraquinone, 4-(2-acryloyl-oxyethyoxy)-phenyl-2-hydroxy-2-propylketone and other similar aromatic carbonyl compounds, and the like; initiators that form radicals by electron transfer or via a donor-acceptor complex, also known as an exciplex, such as methyldiethanolamine and other tertiary amines; photosensitizers used in combination with a radical generating initiator, wherein the sensitizer absorbs light energy and transfers it to the initiator, such as a combination of a thioxanthone sensitizer and a quinoline sulfonyl chloride initiator and similar combinations; cationic initiators that photolyze to strong Lewis acids, such as aryldiazonium salts of the general formula $Ar—N_2^+X—$ wherein Ar is an aromatic ring such as butyl benzene, nitrobenzene, dinitrobenzene, or the like and X is $BF_4$, $PF_6$, $AsF_6$, $SbF_6$, $CF_3SO_3$, or the like, diaryliodonium salts of the general formula $Ar_2I^+ X^-$, wherein Ar is an aromatic ring such as methoxy benzene, butyl benzene, butoxy benzene, octyl benzene, decyl benzene, or the like, and X is an ion of low nucleophilicity, such as $PF_6$, $AsF_6$, $BF_4$, $SbF_6$, $CF_3SO_3$, and the like; triarylsulfonium salts of the general formula $Ar_3S^+ X^-$, wherein Ar is an aromatic ring such as hydroxy benzene, methoxy benzene, butyl benzene, butoxy benzene, octyl benzene, dodecyl benzene, or the like and X is an ion of low nucleophilicity, such as $PF_6$, $AsF_6$, $SbF_6$, $BF_4$, $CF_3SO_3$, or the like; nonradical initiators comprising amine salts of alpha-ketocarboxylic acids, such as the tributyl ammonium salt of phenylglyoxylic acid; and the like, as well as mixtures thereof. Further photoacid generating initiators are disclosed in "The Chemistry of Photoacid Generating Compounds," by J. V. Crivello in *Proceedings of the ACS Division of Polymeric Materials: Science and Engineering,* Vol. 61, pages 62–66, (1989), "Redox Cationic Polymerization: The Diaryliodonium Salt/Ascorbate Redox Couple," by J. V. Crivello and J. H. W. Lam in *Journal of Polymer Science: Polymer Chemistry Edition,* Vol. 19, pages 539–548 (1981), "Redox-Induced Cationic Polymerization: The Diaryliodonium Salt/Benzoin Redox Couple," by J. V. Crivello and J. L. Lee in *Journal of Polymer Science: Polymer Chemistry Edition,* Vol. 21, pages 1097–1110 (1983), "Diaryliodonium Salts as Thermal Initiators of Cationic Polymerization," by J. V. Crivello, T. P. Lockhart and J. L. Lee in *Journal of Polymer Science: Polymer Chemistry Edition,* Vol. 21, pages 97–109 (1983), the disclosures of each of which are totally incorporated herein by reference.

Further examples of suitable initiators include alpha-alkoxy phenyl ketones, O-acylated alpha-oximinoketones, polycyclic quinones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, alpha-halo alphaphenylacetophenones, photoreducible dye-reducing agent redox couples, halogenated paraffins such as brominated or chlorinated paraffin, benzoin alkyl esters, cationic diborate union complexes, anionic di-iodonium ion compounds, and anionic dye-pyrrilium compounds.

Additional examples of suitable initiators are disclosed in, for example, U.S. Pat. No. 4,683,317, U.S. Pat. No. 4,378,277, U.S. Pat. No. 4,279,717, U.S. Pat. No. 4,680,368, U.S. Pat. No. 4,443,495, U.S. Pat. No. 4,751,102, U.S. Pat. No. 4,334,970, "Complex Triarylsulfonium Salt Photoinitiators ]:. The Identification, Characterization, and Syntheses of a New Class of Triarylsulfonium Salt Photoinitiators," J. V. Crivello and J. H. W. Lam, *Journal of Polymer Science: Polymer Chemistry Edition,* Vol. 18, 2677–2695 (1980); "Complex Triarylsulfonium Photoinitiators II. The Preparation of Several New Complex Triarylsulfonium salts and the Influence of Their Structure in Photoinitiated Cationic Polymerization," J. V. Crivello and J. H. W. Lam, *Journal of Polymer Science Polymer Chemistry Edition,* Vol. 18, pages 2697–2714 (1980); "Diaryliodonium Salts A New Class of Photoinitiators for Cationic Polymerization," J. V. Crivello and J. H. W. Lam, *Maromolecules,* Vol. 10, pages 1307–1315 (1977); and "Developments in the Design and Applications of Novel Thermal and Photochemical Initiators for Cationic Polymerization" by J. V. Crivello, J. L. Lee and D. A. Conlon in *Makromol. Chem. Macromolecular Symposium,* Vol. 13/14, pages 134–160 (1988), the disclosures of each of which are totally incorporated herein by reference. Particularly preferred are the diaryl iodonium salts and their derivatives, the triaryl sulfonium salts and their derivatives, and the triphenyl phosphonium salts and their derivatives, with examples of derivatives being those with alkyl, aryl, or alkoxy substituents on the aryl rings. The initiator is present in the curable liquid in any effective amount, typically from about 0.1 to about 10 percent by weight of the liquid, and preferably from about 0.1 to about 3 percent by weight of the liquid.

When a photoinitiator is selected, photopolymerization can be performed with the aid of an autoxidizer, which is generally a compound capable of consuming oxygen in a free radical chain process. Examples of useful autoxidizers include N,N-dialkylaninines, particularly those substituted in one or more of the ortho, meta, or para positions with groups such as methyl, ethyl, isopropyl, t-butyl, 3,4-tetramethylene, phenyl, trifluoromethyl, acetyl, ethoxycarbonyl, carboxy, carboxylate, trimethylsilylmethyl, trimethylsilyl, triethylsilyl, trimethylgermanyl, triethylgermanyl, trimethylstannyl, triethylstannyl, n-butoxy, n-pentyloxy, phenoxy, hydroxy, acetyl-oxy, methylthio, ethylthio, isopropylthio, thio(mercapto-), acetylthio, fluoro, chloro, bromo, or iodo. Autoxidizers when present are present in an effective amount, typically from about 0.1 to about 5 percent by weight, of the curable liquid.

A UV sensitizer which could impart electron transfer, and exciplex-induced bond cleavage processes during radiation curing can, if desired, be included in the liquid developers of the present invention. Typical photosensitizers include anthrecene, perylene, phenothiazine, thioxanthone, benzophenone, fluorenone, and the like. The sensitizer is present in an effective amount, typically from about 0.1 to about 5 pecent by weight, of the curable liquid.

The curable liquids of the present invention can also contain various polymers added to modify the viscosity of the liquid or to modify the mechanical properties of the developed or cured image such as adhesion or cohesion. In particular, when the curable liquid of the present invention is intended for use in polarizable liquid development processes, the liquid can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, New Jersey, ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives.

In addition, curable liquids of the present invention intended for use in polarizable liquid development processes can also contain conductivity enhancing agents. For example, the liquids can contain additives such as quaternary ammonium compounds as disclosed in, for example, U.S. Pat. No. 4,059,444, the disclosure of which is totally incorporated herein by reference.

Further, curable liquids of the present invention intended for use in ink jet processes can also contain water or a mixture of water and a miscible organic component, such as ethylene glycol, propylene glycol, diethylene glycols, glycerine, dipropylene glycols, polyethylene glycols, polypropylene glycols, amides, ethers, carboxylic acids, esters, alcohols, organosulfides, organosulfoxides, sulfones, dimethylsulfoxide, sulfolane, alcohol derivatives, carbitol, butyl carbitol, cellusolve, ether derivatives, amino alcohols, Icetones, and other water miscible materials, as well as mixtures thereof. When mixtures of water and water miscible organic liquids are selected as the liquid vehicle, the water to organic ratio may be in any effective range, and typically is from about 100:0 to about 30:70, preferably from about 97:3 to about 50:50, although the ratio can be outside these ranges. The non-water component of the liquid vehicle generally serves as a humectant which has a boiling point higher than that of water (100° C.). Other additives can also be present. For example, surfactants or wetting agents can be added to the liquid. These additives may be of the cationic, anionic, or nonionic types. Suitable surfactants and wetting agents include Tamol® SN, Tamol® LG, those of the Triton® series available from Rohm and Haas Co., those of the Marasperse® series, those of the Igepal® series available from (GAF Co., those of the Tergitol® series, those of the Duponol® series available from E. I. Du Pont de Nemours & Co., Emulphor ON 870 and ON 877, available from GAF, and other commercially available surfactants. These surfactants and wetting agents are present in effective amounts, generally from 0 to about 15 percent by weight, and preferably from about 0.01 to about 8 percent by weight, although the amount can be outside these ranges. Polymeric additives can also be added to enhance the viscosity of the liquid, including water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, polyethyleneimines derivatized with polyethylene oxide and polypropylene oxide, such as the Discole series available from DKS International, Tokyo, Japan, the Jeffamine® series available from Texaco, Bellaire, Tex., and the like. Polymeric additives may be present in the liquid in any effective amount, typically from 0 to about 10 percent by weight, and preferably from about 0.01 to about 5 percent by weight, although the amount can be outside these ranges. Other optional additives include biocides such as Dowicil 150, 200, and 75, benzoate salts, sorbate salts, and the like, present in an amount of from about 0.0001 to about 10 percent by weight, and preferably from about 0.01 to about 4.0 percent by weight, although the amount can be outside these ranges, penetration control additives such as N-methylpyrrolidinone, sulfoxides, Icetones, lactones, esters, alcohols, butyl carbitol, benzyl alcohol, cyclohexylpyrrolidinone, 1,2-hexanediol, and the like, present in an amount of from 0 to about 50 percent by weight, and preferably from about 5 to about 40 percent by weight, although the amount can be outside these ranges, pH controlling agents, such as acids or bases, phosphate salts, carboxylates salts, sulfite salts, amine salts, and the like, present in an amount of from 0 to about 1 percent by weight and preferably from about 0.01 to about 1 percent by weight, although the amount can be outside these ranges, or the like.

Liquids used in ink jet processes can also contain an ionic compound at least partially ionizable in the liquid to enhance the conductivity of the liquid. Preferably, the ionic compound is selected so that a relatively small amount is required in the liquid to obtain the desired conductivity. For example, it is preferred that the ionic compound exhibit a high degree of dissociation in the liquid, since a higher degree of dissociation results in more free ions present in the liquid and thus results in higher conductivity for a given weight amount of the ionic compound. Generally, preferred ionic compounds exhibit a degree of dissociation of about 100 percent, although ionic compounds exhibiting lower degrees of dissociation can also be used. The ionic compound can be an acid, a base, or a salt. Typical cations include but are not limited to $H^+$, $Li^+$, $Na^+$, $K^+$, $Mg^{2+}$, $Ca^{2+}$, $Fe^{2+}$, $Fe^{3+}$, $Al^{3+}$, $NH_4^+$, and the like. Typical anions include but are not limited to OH—, F—, Cl—, Br—, I—, $NO_3^-$, $SO_4^{2-}$, $CH_3COO^-$, and the like. Specific examples of suitable acids include but are not limited to HCl, HBr, HI, $HNO_3$, $H_2SO_4$, acetic acid, and the like. Specific examples of bases include but are not limited to LiOH, NaOH, KOH, $Mg(OH)_2$, $Ca(OH)_2$, $Fe(OH)_2$, $Fe(OH)_3$, $Al(OH)_3$, $NH_4OH$, and the like. Specific examples of suitable salts include but are not limited to NaCl, $CaCl_2$, NaI, $NaNO_3$, $(NH_4)_2SO_4$, $NH_4Cl$, LiCl, and the like. Generally, ionic compounds that enable higher conductivity per weight unit of ionic compound present in the liquid are preferred. For example, compounds containing low molecular weight cations and anions generally result in higher conductivity per unit weight of compound present in the liquid than do ionic compounds containing high molecular weight cations and anions. Thus, a liquid containing 1 percent by weight of lithium chloride exhibits higher conductivity than a liquid containing 1 percent by weight of potassium iodide, since the liquid containing lithium chloride contains more free ions per unit of weight than the liquid containing potassium iodide. Ionic compounds wherein only a small amount is required in the liquid to achieve the desired conductivity are particularly preferred when the other liquid components or characteristics, such as the dye or the colloidal dispersion stability, can be adversely affected by the presence of large amounts of ions. The ionic compound preferably is selected to optimize solubility of the other ingredients.

The amount of the ionic compound present in the liquid can vary. Typically, the liquid contains from about 0.25 to about 30 percent by weight of the ionic compound; for inorganic ionic compounds, preferably the liquid contains from about 0.5 to about 5 percent by weight of the ionic compound, and for organic ionic compounds, preferably the liquid contains from about 0.5 to about 25 percent by weight of the ionic compound, although the amounts can be outside of these ranges provided that the desired conductivity is achieved. This amount reflects the total amount of ionic compound present in the liquid; thus, if another liquid component, such as a dye or one of the additives, is also ionic, the amount of this material is also included in these ranges. The amount of the ionic compound present generally will also depend on the size and valency of the ions in the compound, the desired printing process speed, the desired liquid conductivity, the size of the image with respect to dimensions and liquid deposition density (milligrams per square centimeter) on paper, and the like.

In some embodiments, the curable liquids employed in the process of the present invention have a conductivity of at least about 10 milliSiemens per centimeter, preferably at least 12 milliSiemens per centimeter, and more preferably from about 20 to about 50 milliSiemens per centimeter.

The liquid image is developed by any suitable method of applying the retroreflective filler particles to the liquid. In some instances, when curable liquids are used, it may be desirable to enhance the tackiness of the liquid layer by partially curing the liquid image prior to application of the colored material. One suitable means of applying the retroreflective filler particles to the liquid entails the use of conventional xerographic techniques. For example, the filler particles can be brushed over the image by means of a magnetic brush, or by a monocomponent scavengeless donor roll, wherein the retroreflective filler particles adhere to the liquid but not to the surrounding areas. When these methods are used, it may be preferred to cure the liquid image partially prior to development to render the image tacky and more attractive to the filler particles. Other conventional xerographic development techniques, both those involving contact of the particle applicator to the image and those entailing non-contact "jumping" development, can also be used, such as powder cloud development, cascade development, and the like.

Another suitable means for applying the retroreflective filler particles to the liquid image entails stripping the image from a donor layer of the filler particles. In this instance, the filler particles are applied in a layer to a support to form a donor element, the substrate bearing the liquid image is brought into contact with the layer of filler particles on the donor element, and the substrate and donor element are subsequently separated, resulting in formation of a positive image on the substrate, where the retroreflective filler particles have adhered to the liquid image, and a negative image on the donor element, where filler particles have been removed in imagewise fashion. The donor element can have any suitable configuration, such as a sheet, a strip, a cylindrical roll, a continuous belt, or the like.

When a donor element is employed to develop the liquid image, higher quality images are obtained if the donor layer comprises a uniform layer of filler particles; this uniformity of the donor layer is most readily achieved if the support portion of the donor element, upon which the donor layer of particles resides, is smooth. In addition, if high resolution images are desired, it is preferred that the support portion of the donor element be thin and flexible, thus allowing the donor element to conform to the image and make the contact between liquid image and donor layer of filler particles more complete. As is well known, the resolution in a particulate system is limited by the particle size and particle size uniformity of the particles. The internal bond between particles in the donor layer and the bond between particles in the donor layer and the substrate of the donor element preferably are great enough to ensure the integrity of the donor element, but not so great as to prevent stripping of the retroreflective filler particles from the support in imagewise fashion upon contact with the liquid image and subsequent separation of the substrate and the donor element. Preferably, the support is of an expendable material, although in some instances it is also desired to use the complementary image remaining on the support, in which case this image may be fused or fixed to the support by any suitable means, such as heat, application of vapor or solvents, application of a curable liquid followed by curing of the liquid, or the like. Particularly preferred materials for the donor element support include polyester films, such as Mylar®, which exhibit dimensional stability, high strength, and transparency. The donor layer of retroreflective filler particles should be uniformly releasable from the support, and a layer of particles is generally the preferred configuration.

Subsequent to development of the liquid image with the retroreflective filler particles, when a curable liquid is employed, the image is cured, causing the curable liquid to solidify. When development of the image takes place on an imaging member or intermediate prior to transfer to a final substrate, curing can take place before transfer or after transfer. In situations such as electrographic imaging wherein the image is developed directly on the substrate and no transfer occurs, the image is cured subsequent to development. When transfer to a substrate is desired, the developed image can be partially cured prior to transfer; partial curing can impart tacky surface characteristics to the developed image, which can enhance transfer to a substrate. In addition, curing subsequent to transfer can greatly enhance adhesion of the image to the final substrate, since the curable liquid can penetrate the final substrate, particularly when the final substrate is porous, such as cloth or paper, and curing results in the image being tightly bound to the fibers of the substrate. In addition, curing subsequent to transfer can greatly enhance adhesion to the final substrate, whether the final substrate is smooth or porous, when the final substrate has reactive sites, either naturally occurring as in cellulose or clays, or added as a precoating, with which reactive species in the liquid developer can react.

Curing can be by any suitable means, and generally is determined by the nature of the initiator selected, if any. When a photoinitiator is selected, curing is effected by exposure of the image to radiation in the wavelength to which the initiator is sensitive, such as ultraviolet light. Examples of suitable ultraviolet lamps include low pressure mercury lamps, medium pressure mercury lamps, high pressure mercury lamps, xenon lamps, mercury xenon lamps, arc lamps, gallium lamps, lasers, and the like. When a thermal initiator is selected, the image is heated to a temperature at which the initiator can initiate curing of the liquid vehicle and maintained at that temperature for a period sufficient to cure the image. Electron beam curing can be initiated by any suitable electron beam apparatus. Examples include scanned beam apparatuses, in which electrons are generated nearly as a point source and the narrow beam is scanned electromagnetically over the desired area, such as those available from High Voltage Engineering Corporation, Radiation Dynamics, Inc. (a subsidiary of Monsanto Company), Polymer Physik of Germany, or the like, and linear-filament apparatuses or curtain processor apparatuses, in which electrons are emitted from a line-source filament and accelerated perpendicular to the filament in a continuous linear curtain, such as those available from Energy Sciences, Inc. under the trade name Electrocurtain. Ion beam curing can be initiated by any suitable means, such as a corotron.

In a specific embodiment of the present invention, images are generated on a substrate by an electrophotographic, ionographic, or electrographic process, and additional images are also generated on the substrate by an ink jet printing process. One embodiment of the present invention is directed to a process for generating images which comprises generating an electrostatic latent image on an imaging member in an imaging apparatus; developing the latent image with a toner comprising a resin and a colorant; transferring the developed image to a substrate; optionally permanently affixing the transferred image to the substrate; and causing droplets of an ink composition comprising an aqueous liquid vehicle, an optional colorant, and a retroreflecting filler to be ejected in an imagewise pattern onto the substrate.

Images can be generated on any desired substrate with the compositions and processes of the present invention. Examples of suitable substrates include plain papers such as Xerox® 4024 papers, ruled notebook paper, bond paper, silica coated papers such as Sharp Company silica coated paper, JuJo paper, and the like, transparency materials, fabrics, textile products, plastics, opaque filled plastics, polymeric films, inorganic substrates such as metals and wood, and the like.

In one embodiment of the present invention, images are formed with a marking material containing a retroreflective filler material on a substrate, such as paper, transparency, manila folders, envelopes, or the like, and the resulting image is employed to communicate information to an imaging apparatus. The use of taggants in marking materials to embed information in a document in a manner generally transparent to the casual user is disclosed in, for example, U.S. Pat. No. 5,225,900 (Wright), the disclosure of which is totally incorporated herein by reference. For example, on paper, images are generated in any desired form (graphics, text, barcodes, or the like) on the paper with a marking material containing retroreflective filler materials. The image is not easily visible to the naked eye under ordinary viewing conditions, but upon illumination of the image with light from a specific direction and viewing the illuminated image along a line colinear with the direction of illumination, the image is highly visible. The information thus "embedded" in the document can be employed in a variety of ways. For example, in electronic reprographic printing systems, a document or series of documents comprising at least one print job is successively scanned. Upon scanning of the documents, image signals are obtained and electronically stored. Once a document is scanned, it can be printed any number of times or processed in any number of ways (e.g., words deleted or added, image magnified or reduced, filtered, screened, cropped, and the like). If a plurality of documents makes up a job which is scanned, the processing or manipulation of the scanned documents can include deletion of one or more documents, reordering of the documents, or addition of a previously or subsequently scanned document or documents. The signals are then read out successively and transferred to a printer or display device for formation of images comprising some or all of the information on the original image as well as any other information added during the image processing stage. The printing or processing can be relatively synchronous with scanning, or asynchronous after scanning. The system can accumulate a number of scanned jobs in the system memory for subsequent processing or printing. The order of the jobs to be printed may be different from the order in which the jobs are scanned depending on the priority of the jobs and the desires of the operator for increasing productivity or through-put and decreasing printer or scanner down-time. In addition to the image information which is entered into the system, other information needed to produce the final product may also be entered into the system by an operator. This information may relate to such factors as size of document, type of font, size of font, and the like. In a printing system such as an electronic reprographic system, several devices usually make up the total system, with separate devices or components providing the functions of scanning, processing, printing, and finishing (e.g., stapling, binding, and the like). The system includes a controller which provides for the overall monitoring and integrating of the performance of the aforementioned functions. In an electronic reprographic system, the materials employed to "fix" the images being manipulated and processed in the system are substantially the same as those used in other copying or printing systems, and include marking materials, such as toners or ink-jet inks.

Marking materials according to the present invention which contain retroreflective filler particles enable a reproduction system to obtain information from an image on a document entered into the system by means of the retroreflective filler particles contained in the marking materials forming that image. A scanner is preferably used to obtain the information from the images. The scanner may be, but need not be, a separate component connected to any image processor. For example, a scanner may be connected to a light lens xerographic system. However this arrangement constitutes a relatively inflexible system. Preferably, a scanner is incorporated into an electronic reprographic system as described above. This arrangement permits the image signals to be manipulated in numerous ways with a great degree of flexibility.

Marking materials may include visible materials, such as toner, ink, or marking film. They may also (or alternatively) include materials which are visible only in the ultraviolet or infrared portions of the light spectrum. Marking materials containing retroreflective fillers may be applied to a substrate by any known means, preferably by a mechanical or electromechanical printing process such as lithography, xerography, ionography, electronic reprography, thermal transfer printing (for example by being incorporated in a thermal transfer film), ink jet printing, encapsulated marking material printing, impact printing (for example through being incorporated into an impact printer ribbon such as a dot matrix or typewriter ribbon), silk screen printing, pens, brushes, or the like.

The presence or absence of retroreflecting fillers at specific locations on a document can be detected by optical scanners in the reproduction system. This information can then be processed further to perform, for example, the special functions of a printing system. Many printing systems are capable of performing various specialized functions between the scanning and printing function such as color enhancement, correction and translation, document "dry-cleaning", and a number of security applications. These functions may be either enabled or controlled by the information made available by the image containing the retroreflecting filler particles.

When an original document is in color, the presence of the retroreflective filler may provide information related to the nature and color of the marking material in which the retroreflecting filler is incorporated. For example, in a color reproduction process employing two different colored toners, one toner may be provided with a retroreflective filler material specific to the particular toner or colorant therein. Upon production of a color document containing this toner, the retroreflective filler particles remain in the developed document. Subsequently, these filler particles can be recognized with the appropriate apparatus.

Color correction, color enhancement, and color translation can be facilitated by the marking materials of the present invention. In reproducing color originals, three values (e.g., red, green, blue) are normally generated by a color scanner, and can then be used to calculate colorimetric data through any of a variety of techniques. For colorimetrically accurate reproduction, the reproduction system must obtain accurate spectral response values (i.e., spectrophotometric curve) from the original, and replicate those values with colorimetric precision in the marking material it uses to generate the copy. Existing color copying systems can adequately replicate the spectral response values which reach their image processing equipment because they are designed to use specific marking materials with known spectral responses. These known marking materials may be combined in a known manner to achieve specified colors. However, the spectral response values which reach the image processing equipment of existing reproduction systems are often inaccurate, because the marking materials of the original are generally unknown and variable. For example, a green colorant of one type may not be exactly the same color as a green colorant of another type. A conventional reproduction system will obtain an averaged value when it scans an image containing such a colorant, or an image containing a combination of colorants, and will use that averaged value as the basis for application of marking materials on the copy. This often results in the copy having a different color appearance from the original.

According to the present invention, however, a reproduction system will be able to identify the particular material forming the image being scanned by recognition of retroreflecting fillers therein. From information preprogrammed into its memory, the system will be able to adjust the scanned color values to accurate colorimetric values using spectral response data for the specific marking materials identified. It can then create a reproduced image on a display device or via a printing system based on the actual spectral response values of the original image in a known manner. Thus the invention can provide for color correction in a simple manner based upon the incorporation of identifiable retroreflecting fillers in various marking materials.

Variants of color correction are also enabled by the present invention. For example, rather than precisely duplicating the original image, a specific color component of the original image can effectively be enhanced in the copy without enhancing other colors in the original image as might occur in existing reproduction systems. Alternatively, the information about the original colors provided by the retroreflecting fillers can permit simplified translation from one set of colors to another.

A system of the present invention may also be employed so that the text of a document and annotations on the document can be separately identified either as being a part of an original document or as being subsequently applied marks. If marks are subsequently applied to documents produced from marking materials containing retroreflecting fillers as described above, these marks can be separately identified and distinguished. Ink or pencil annotations can be distinguished from the filler-containing toner, ink or marking film material in the original image. For example, an original image may be formed using a marking material containing a retroreflecting filler. When marks are subsequently applied to the original, these marks can be distinguished from the original image. Upon reproduction, the original image can be reproduced with or without the subsequently applied marks. This process can, for example, be used to make a clean copy from a document that has been annotated or, to the contrary, to make a copy in which annotations are highlighted or are even the only image copied. The scanner identifies the retroreflecting filler material and distinguishes it from material not containing the filler, and utilizes the information during reproduction.

Retroreflecting fillers may also provide security for important documents. The reproduction system can identify documents (as well as marking materials) containing retroreflecting fillers which may be present in the toner or ink used to create an image on the document. Thus, copies made using such toner or ink can be readily identified. This can permit subsequent identification of the source of an image, generally by type of machine (e.g., for statistical data gathering) or more specifically by facility where a copy was made or even by the specific machine unit in which a copy was made (e.g., for document tracking).

Documents or portions thereof may also be made incapable of being copied by using marking materials containing retroreflective fillers for at least the portion of the document for which protection is desired. The identification of the retroreflective filler may signal the system to prevent scanning, storing, or developing operations, of the whole document or areas where the retroreflecting filler is present. Similarly, images made by machines which do not provide retroreflecting fillers can readily be distinguished from filler-containing images, thus facilitating document control.

In addition, marking materials containing retroreflecting filler particles and also containing colorants can be employed when it is desired to distinguish between two or more different kinds of marks, since the optical detectors can be selected so that they can detect the color differences between the different marks as well as the presence or absence of the retroreflecting material.

In another embodiment of the present invention, a marking material containing a retroreflective filler is applied to a moving component within an imaging apparatus, such as an imaging member, an intermediate transfer member, or the like. An optical detector in the imaging apparatus containing the moving component then illuminates the moving component from a specific direction and detects the presence or absence of a reflection from a direction colinear with the direction of illumination. The relative position of the moving component in the imaging apparatus can then be determined.

Known methods for detecting the relative position of a moving component such as an imaging member in an imaging apparatus typically entail one of two means. In one method, one or more holes are punched in an area of an imaging member not generally used for imaging. An optical detector is placed on one side of the imaging member and an illumination source is placed on the other side of the imaging member. When the hole or holes in the imaging member pass the optical detector, light passes through the hole or holes and thus indicates to the detector the relative position of the imaging member. In another method, one or marks are made on the imaging member in an area not generally used for imaging, and a detector senses the presence or absence of the marks, thus determining the relative position of the imaging member. These known methods are disclosed in, for example, U.S. Pat. No. 4,135,664, U.S. Pat. No. 5,175,570, U.S. Pat. No. 5,175,564, U.S. Pat. No. Re. 32,967, U.S. Pat. No. 4,963,899, U.S. Pat. No. 4,912,491, U.S. Pat. No. 5,208,796, U.S. Pat. No. 5,204,620, and U.S. Pat. No. 5,160,946, the disclosures of each of which are totally incorporated herein by reference, and in copending applications U.S. Ser, No. 07/807,927, now U.S. Pat. No. 5,302,993, U.S. Ser. No. 07/946,703, now U.S. Pat. No. 5,260,725, U.S. Ser. No. 07/931,802, now U.S. Pat. No. 5,278,625, U.S. Ser. No. 07/859,746, U.S. Ser. No. 07/991,228, now U.S. Pat. No. 5,321,434, U.S. Ser. No. 07/970,889, now U.S. Pat. No. 5,278,587, U.S. Ser. No. 08/055,335, now U.S. Pat. No. 5,412,409, U.S. Ser. No. 07/995,650, U.S. Ser. No. 07/807,931, now U.S. Pat. No. 5,300,961, U.S. Ser. No. 07/821,526, now U.S. Pat. No. 5,442,388, U.S. Ser. No. 07/992,685, now U.S. Pat. No. 5,248,027, U.S. Ser. No. 07/862,150, now U.S. Pat. No. 5,272,493, U.S. Ser. No. 08/063,796, now U.S. Pat. No. 5,383,014, and U.S. Ser. No. 08/035,830, now U.S. Pat. No. 5,339,150, the disclosures of each of which are totally incorporated herein by reference.

In this embodiment of the present invention, the retroreflecting mark can be placed on the moving component by any desired method. For example, a marking material of the present invention containing retroreflective filler particles can be placed on the moving component by any suitable method, such as dry electrostatic development with dry toner particles, liquid electrostatic development with a liquid developer, ink jet printing with an aqueous ink, strip-out development processes, or the like. Any other known method can also be employed, such as applying a paint, an ink suitable for use in a hand-held pen, an ink applied from a transfer element such as a typewriter ribbon, or the like. Further, commercially available retroreflecting strips or tapes can be employed to place the marks on the moving component. In situations wherein it is desired to distinguish between two or more different kinds of marks, the marks can be applied in different shapes or sizes. In addition, marking materials containing retroreflecting filler particles and also containing colorants can be employed when it is desired to distinguish between two or more different kinds of marks, since the optical detectors can be selected so that they can detect the color differences between the different marks as well as the presence or absence of the retroreflecting material.

This embodiment of the present invention exhibits several advantages over known methods for detecting the relative position of a moving component such as an imaging member in an imaging apparatus. For example, methods entailing the placing of one or more holes in an imaging member can weaken the belt or compromise its structural integrity; in some instances, particularly those wherein multicolor images are generated and must be registered on the imaging member, 10, 15, or more location marks may be required on the imaging member. The process of the present invention does not require that holes be placed in the imaging member, and as many marks as desired can be placed on the member without weakening it or compromising its structural integrity. In addition, when holes are placed in the imaging member, the optical detector and the illumination source must be situated on opposite sides of the imaging member, which reduces the possible configurations of the machine components. The process of the present invention enables the illumination source and the optical detector to be situated on the same side of the imaging member. For known methods entailing the placing of one or more marks on the imaging member, the optical detector generally must be placed in close proximity to the mark or marks on the imaging member, and careful alignment of the optical detector is required. In contrast, the process of the present invention enables placement of the optical detector at a location relatively distant from the imaging member, since the contrast between areas marked with retroreflecting material and areas not so marked remains great even over distances too great for an optical detector to detect conventional marks. For both known methods, the optical detector generally must be situated so that it detects light from an angle substantially normal to the plane of the photoreceptor (or along a line colinear with a radial line of the photoreceptor in situations wherein a cylindrical drum or belt is employed). In contrast, the process of the present invention enables situation of the optical sensor and the illumination source at an angle other than normal to the surface of the photoreceptor; good results can be obtained even when the optical sensor and illumination source are situated so that illumination and detecting are at an angle of 60° or more from the normal. This advantage is enabled by the nature of the retroreflecting marking material; incident light striking the imaging member surface in an unmarked area is reflected away from the surface so that it does not strike the optical detector, whereas incident light striking the area of the imaging member marked with a retroreflective material is reflected back toward the optical detector along a line colinear with the direction of illumination. Thus, a far greater degree of flexibility is possible in designing and configuring the imaging apparatus and its components. This flexibility is particularly desirable in imaging apparatus wherein multicolor images are generated and several developer housings (and possibly several charging, exposing, and other copier components) must be fitted into the relatively small space around the imaging member.

For the embodiments of the present invention wherein retroreflective marking material is situated either on a substrate such as paper or on an imaging member, the presence or absence of the retroreflecting mark can be detected by any known or otherwise suitable optical detector capable of sensing the presence of reflected visible light. Most retroreflecting materials reflect infrared light as well as visible light, and sensors capable of detecting reflected infrared light are suitable as well. For example, the infrared detectors supplied in a Xerox® 1075 copier or a Xerox® 1090 copier are capable of detecting infrared illumination at around 940 nanometers, and are suitable for the purposes of the present invention. The illumination source is situated so that light is directed onto the retroreflecting mark from an angle nearly colinear with the line of detection of reflected light. For example, the illumination source and the optical detector can be situated side by side in the imaging apparatus. Another possibility is the use of a beam splitter, as in the Xerox® 1075 and 1090 infrared detectors.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Colorless dry toner compositions suitable for developing electrostatic images are prepared as follows. 85 parts by weight of a styrene-butadiene copolymer containing 89 percent by weight styrene and 11 percent by weight butadiene (Pliotone®, available from Goodyear Tire and Rubber Company) and 1 part by weight of distearyl dimethyl ammonium methyl sulfate (available from Hexcel Corporation), are melt blended in an extruder wherein the die is maintained at a temperature of between 130° and 145° C. and the barrel temperature ranges from about 80° to about 100° C., followed by micronization and air classification to yield resin particles of a size of 11.5 microns in volume average diameter. These resin particles are then admixed with retroreflecting filler particles ("Visibeads" T-4 high index glass beads with a size range of 53 to 90 microns, available from Potters Industries, Carlstadt, N.J.) in relative ratios (resin:retroreflecting filler) of 10:90, 20:80, 30:70, 40:60, 50:50, 60:40, 70:30, 80:20, and 90:10 to form 9 colorless toner compositions.

Red dry toner compositions suitable for developing electrostatic images are prepared as follows. 85 parts by weight of a styrene-butadiene copolymer containing 89 percent by weight styrene and 11 percent by weight butadiene (Pliotone®, available from Goodyear Tire and Rubber Company), 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation are melt blended in an extruder wherein the die is maintained at a temperature of between 130° and 145° C. and the barrel temperature ranges from about 80° to about 100° C., followed by micronization and air classification to yield toner particles of a size of 11.5 microns in volume average diameter. These red particles are then admixed with retroreflecting filler particles ("Visibeads" T-4 high index glass beads with a size range of 53 to 90 microns, available from Potters Industries, Carlstadt, N.J.) in relative ratios (resin:retroreflecting filler) of 10:90, 20:80, 30:70, 40:60, 50:50, 60:40, 70:30, 80:20, and 90:10 to form 9 red toner compositions.

The toners thus prepared are then optionally blended with 0.3 parts by weight of Aerosil® R972 and 0.3 parts by weight of zinc stearate onto the surface of the toner particles in a Lodige blender.

A carrier composition is prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate. The carrier is coated by a solution coating process from a methyl ethyl ketone solvent and the dry coating is present in an amount of 1.0 part by weight coating per 100 parts by weight core.

Subsequently, two-component developers are prepared by blending together 100 parts by weight of the carrier and 3 parts by weight of each toner, introducing the toner and carrier into a Lodige high intensity blender and blending them together at 200 revolutions per minute for 20 minutes.

The developers thus prepared are incorporated into a xerographic imaging apparatus and employed to develop electrostatic latent images. The developed images contain retroreflecting filler particles.

EXAMPLE II

A colorless, retroreflecting ink suitable for use in ink jet printers is prepared by first mixing 15.0 grams of Daxad 19K (W. R. Grace, Deer Park, Tex.) with 300 grams of distilled water. With stirring, this admixing step takes about 10 to 15 minutes. Thereafter, 60 grams of Potters T-4 high index glass beads (Potters Industries, Carlstadt, N.J.) are added slowly to the Daxad solution with stirring. The resulting dispersion is stirred overnight to disperse the glass beads uniformly throughout the solution. Subsequently, 31 grams of this dispserion is added to 25 grams of ethylene glycol (Aldrich Chemical Co., Milwaukee, Wis.). To the resulting mixture is then added 0.4 grams of Duponol ME Dry Surfactant (E.I. DuPont de Nemours & Co., Wilmington, Del.), 0.05 grams of Dowicil 200 Preservative (Dow Chemical Co., Midland, Mich.), and 43 grams of distilled water, all with stirring. The pH of the dispersion is then adjusted to about 7 by the addition of 0.5 Molar KOH. The ink thus formed is incorporated into a Hewlet-Packard DeskJet® 500 thermal ink jet printer and retroreflective images are generated on paper.

The ink thus formed is also incorporated into a continuous-stream ink jet printer as disclosed in U.S. Pat. No. 4,347,521, the disclosure of which is totally incorporated herein by reference, which printer is subsequently modified as disclosed in U.S. Pat. No. 4,395,716, the disclosure of which is totally incorporated herein by reference, and retroreflective images are generated on paper.

The ink thus formed is also incorporated into a drop-on-demand printer DEA as disclosed in S-G. Larsson and G. Lundquist, Research Report No. 10, 1973, Chalmers University of Technology, Gothenburg, Sweden, the disclosure of which is totally incorporated herein by reference, and retroreflective images are generated on paper.

An additional ink suitable for ink jet printing is generated as described above with the exception that 11 grams of Basacid Black X34 (BASF) dye is added to the dispersion before the pH is adjusted to 7 with KOH, and the resulting ink is black in color.

EXAMPLE III

A UV-curable, retroreflecting liquid developer suitable for polarizable liquid development processes is prepared by first mixing 10 grams of Potters T-4 high index glass beads with 90 grams of decyl vinyl ether (Decave, International Flavors and Fragrances, New York, N.Y.). In addition, a 30 percent by weight solution of styrene-butylmethacrylate (equal molar monomers) copolymer with a molecular weight of about 50,000 in butanediol divinylether (Rapi-Cure BDVE, GAF, Linden N.J.) is prepared. Thereafter, equal parts by weight of these two preparations are admixed. A UV initiator, di(isobutylphenyl)iodinium hexafluoroarsenate, is prepared as described by Crivello and Lam, *Macromolecules*, 10(6) 1307, 1977. Subsequently, 90.92 parts by weight of the polymer dispersion, 4.45 parts by weight of devyl vinyl ether (Decave), 4.54 parts by weight of butanediol divinylether (Rapi-Cure BDVE), and 0.20 parts by weight of the iodinium initiator are admixed to form a developer. This developer is incorporated into an imaging test fixture employing the polarizable liquid development process to generate a colorless, retroreflecting image from an electrostatic image. The image thus formed is cured to a solid by passing the image through a Hanovia UV-6 cure station, Hanovia, Newark, N.J., with the UV lamp set to 300 watts and the conveyor traveling at 20 feet per minute.

EXAMPLE IV

In a Union Process 1-S Attritor (Union Process Co., Akron, Ohio) is placed 200 grams of a copolymer of ethylene and methacrylic acid (89:11 molar ratio) with a melt index at 190° C. of 100 and an Acid Number of 66, and 1000 grams of Isopar®) L (Exxon Corp.). The attritor contents are heated to 100° C., and milled at a rotor speed of 230 rpm with 4.76 mm diameter stainless steel balls for two hours. The attritor is then cooled to room temperature while the milling is continued. Subsequently, 700 grams of Isopar® H is added to the attirtor contents and milling is continued at a rotor speed of 330 rpm for 3 hours. The resulting particulate polymer dispersion is then drained to a holding tank. Thereafter, 22 grams of Potters T-4 high index glass beads and 92 grams of Basic Barium Petronate (Witco Chemical, New York, N.Y.) are added to the dispersion with stirring. Sufficient Isopar® H is also added to the dispersion to result in a 2 percent by weight solids dispersion, and the dispersion is stirred for 3 hours. The colorless, retroreflecting electrophoretic developer thus formed is incorporated into a Savin 870 copier and retroreflecting images are generated on paper.

An additional electrophoretic developer is prepared by the above process with the exception that 15 grams of Heucophthal Blue G XBT-583D (Heubach, Inc., Newark, N.J.) pigment is added to the Union Process 1-S Attritor along with the copolymer to be milled at 100° C., and the resulting developer is cyan in color.

EXAMPLE V

A curable liquid suitable for use in thermal (bubble-jet) drop-on-demand ink jet processes is prepared as follows. A solution is prepared by mixing together 90 grams of triethylene glycol divinylether (Rapi-Cure DVE-3, available from GAF, Wayne, N.J.), 7.5 grams of a sulfonium salt initiator, FX-512 (available from 3M, Minneapolis, Minn.), 90 grams of ethylene glycol, and 90 grams of water.

An image is generated by incorporating the liquid thus prepared into a Hewlett-Packard ThinkJet thermal ink jet printer and jetting the liquid onto a paper substrate. The liquid image on the paper is then contacted with a donor element comprising a Mylar® support coated with a thin layer of wax onto which has been deposited a monolayer of glass reflector beads which are to be transferred imagewise to the receiver sheet. On areas of the receiver sheet bearing the tacky liquid image, glass beads are transferred adhesively from the donor to the receiver to form the desired pattern of glass beads corresponding to the liquid image. Thereafter, the image is fixed by passing the paper bearing the image through a Hanovia UV-6 cure station (Hanovia, Newark, N.J.) with the ultraviolet lamp set to 100 watts and the conveyor traveling at 5 feet per minute.

EXAMPLE VI

A black developer composition is prepared as follows. 92 parts by weight of a styrene-n-butylmethacrylate resin, 6 parts by weight of Regal 330® carbon black from Cabot Corporation, and 2 parts by weight of cetyl pyridinium chloride are melt blended in an extruder wherein the die is maintained at a temperature of between 130° and 145° C. and the barrel temperature ranges from about 80° to about 100° C., followed by micronization and air classification to yield toner particles of a size of 12 microns in volume average diameter. Subsequently, carrier particles are prepared by solution coating a Hoeganoes Anchor Steel core with a particle diameter range of from about 75 to about 150 microns, available from Hoeganoes Company, with 0.4 parts by weight of a coating comprising 20 parts by weight of Vulcan carbon black, available from Cabot Corporation, homogeneously dispersed in 80 parts by weight of a chlorotrifluoroethylene-vinyl chloride copolymer, commercially available as OXY 461 from Occidental Petroleum Company, which coating is solution coated from a methyl ethyl ketone solvent. The black developer is then prepared by blending 97.5 parts by weight of the coated carrier particles with 2.5 parts by weight of the toner, in a Lodige Blender for about 10 minutes, resulting in a developer with a toner exhibiting a positive triboelectric charge.

The black developer thus prepared and any one of the red developers prepared in Example I are then incorporated into an imaging device equipped to generate and develop tri-level images according to the method of U.S. Pat. No. 4,078,929, the disclosure of which is totally incorporated herein by reference. A tri-level latent image is formed on the imaging member and the low areas of −100 volts potential are developed with the red developer, followed by development of the high areas of −750 volts potential with the black developer, subsequent transfer of the two-color image to paper, and heat fusing of the image to the paper. The red images contain retroreflecting fillers.

EXAMPLE VII

A retroreflecting ink to make nonobtrusive marks on white paper was prepared by shaking 2.0 g of Testor's Flat White paint 1145 (Testor Corp., Rockford, Ill.), 1.0 g of Testor's 1156 cleaner, and 2.5 g of Potter's T-4 high index glass beads (Potters Industries, Carlstadt, N.J.) in a glass vial for about one minute by hand. A control white ink containing no retroreflecting elements was also prepared by shaking 1.5 g Testor's Flat White paint and 0.2 g Testor's 1156 cleaner in a glass vial for about one minute by hand. The word "XEROX" in letters about 1 inch high was printed with both inks on separate sheets of white paper (Xerox® 4024) using Pasteur Pipets (VWR, Media, Pa.). Subsequent to drying of the images, in normal room light the written words were barely noticeable on either paper when viewed from a distance of about three feet. However, when illuminated with a penlight held close to the side of the head to provide nearly colinear illumination and detection, the word written with the retroreflecting ink was substantially much brighter and more distinct. The difference between the retroreflecting image and the control image was even more dramatic when viewed at longer distances; when the retroreflecting image was illuminated with the penlight from a distance of about 30 feet, the image was easily read, whereas the white paint mark of the control was indistinct under the same conditions.

EXAMPLE VIII

Figure 2:
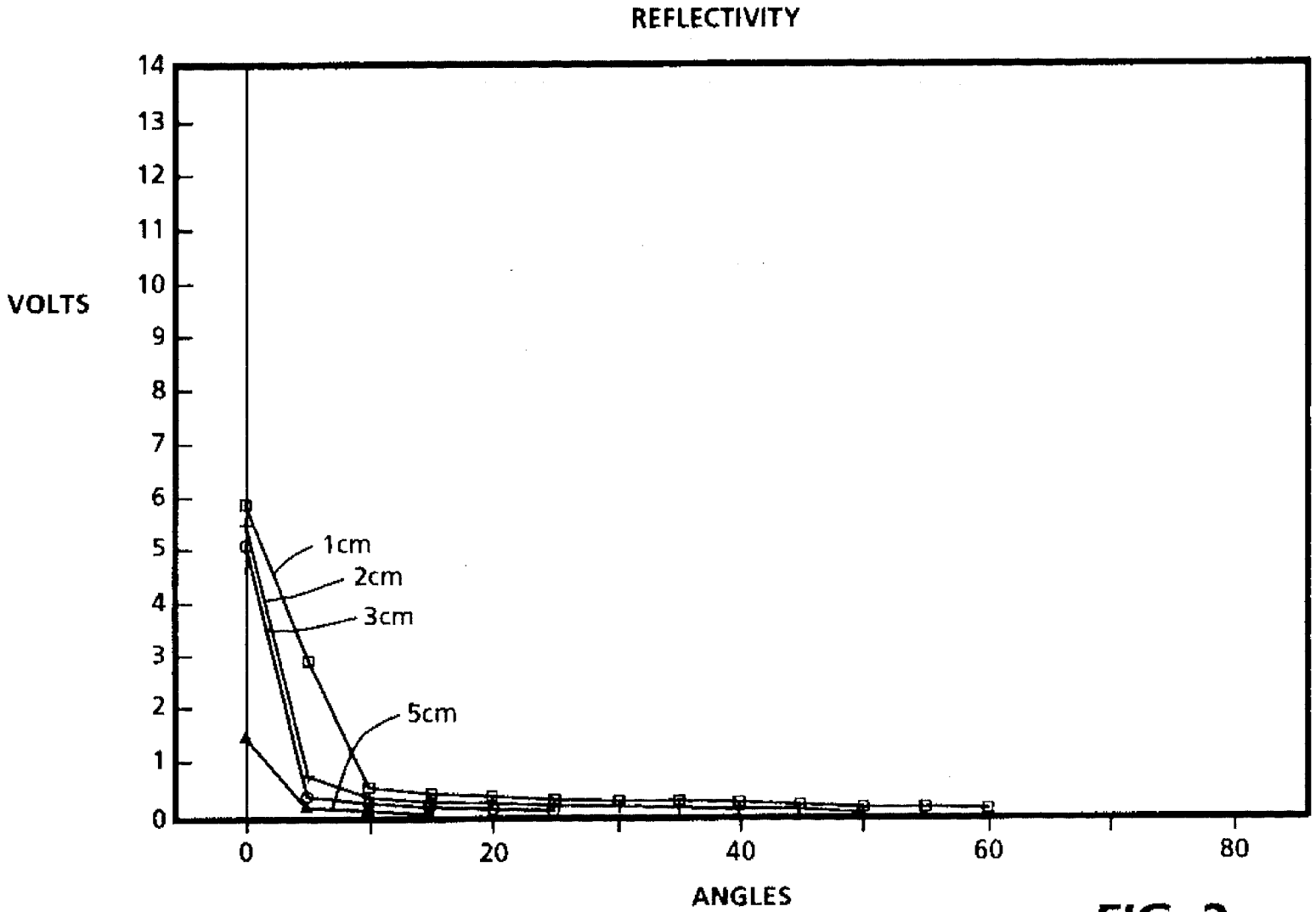
FIG. 2 is a graphical representation of data showing the output of a CIRD when illuminating a belt photoreceptor as a function of illumination angle and distance from the detector to the photoreceptor.

The use of retroreflectors as timing marks on a photoreceptor belt used in xerographic copiers and printers was simulated as follows. In a typical prior art machine, the standard timing marks on belt photoreceptors are rectangular holes in the opaque ground strip. A light source is put on one side of the belt, a detector on the other. The time at which the timing hole passes can be determined by situating a light source on one side of the belts and a detector on the other. (Another method to detect the hole is to use a an infrared source to illuminate the opaque ground strip as it moves.) The illuminating beam comes from a 940 nanometer wavelength light emitting diode. By passing the beam through a beam splitter, the light reflected off the conductive ground plane can be detected at nearly 90° specular reflectance. Such a device is a Xerox® 1075 CIRD (part number 130S941, Xerox Corp., Rochester, N.Y.). If the illumination falls on the timing hole, no light is reflected. FIG. 2 shows the output of a CIRD when illuminating a belt photoreceptor as a function of illumination angle and distance from the detector to the photoreceptor. As can be seen from the data on the graph, the maximum signal is at the closest distance and the angles closest to normal (0°), and at angles of 5° or 10°, the signal has dropped significantly. Zero voltage is the reading when the illumination is on the timing hole, so that the maximum signal difference is about 6 volts when the detector is at the normal and within 1 cm of the photoreceptor surface. This result places a relatively tight constraint on the position of the CIRD.

Figure 3:
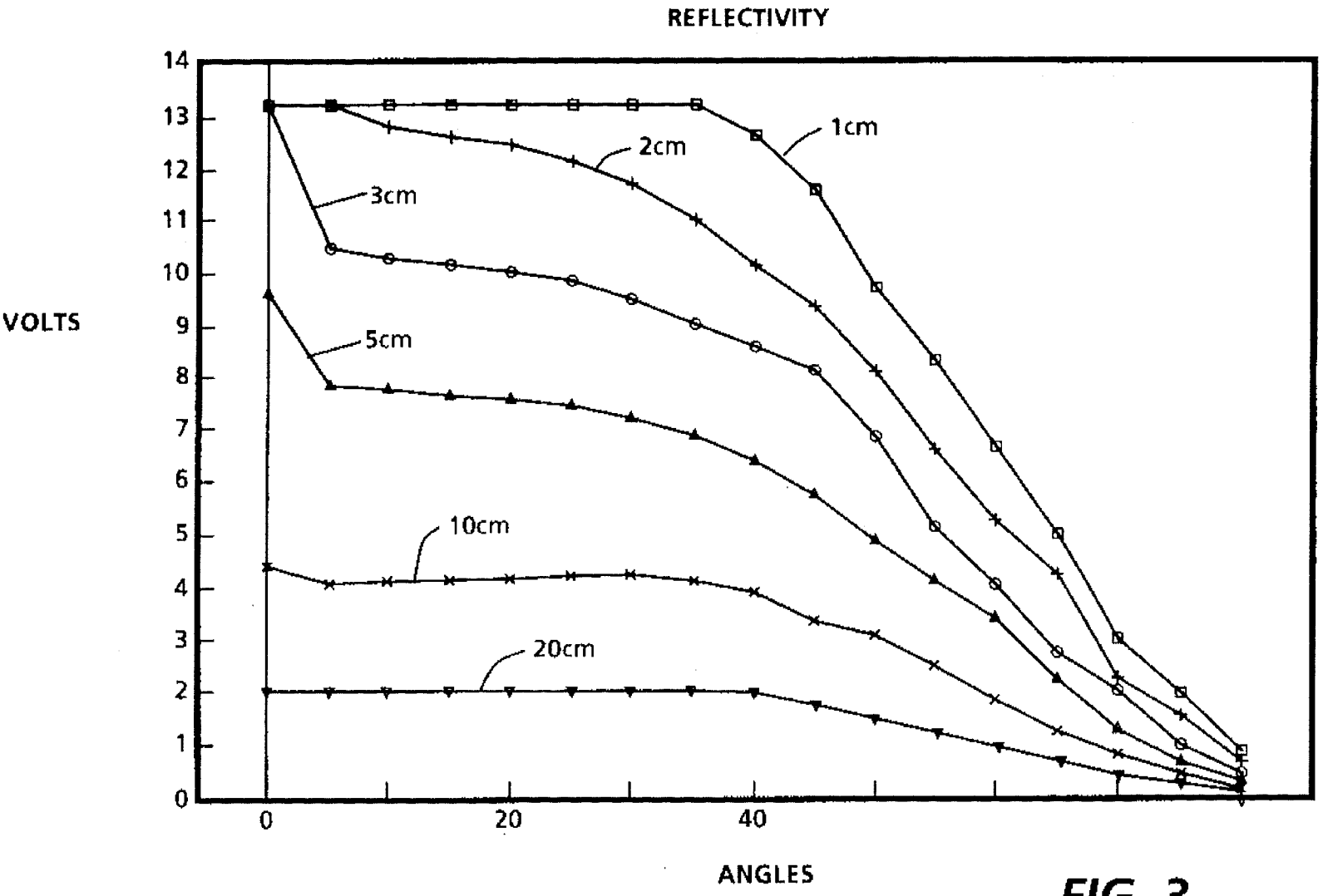
FIGS. 3, 4 and 5 are graphical representations of data showing the output of a CIRD when illuminating retroreflecting materials as a function of illumination angle and distance from the detector to the retroreflecting materials.
Figure 4:
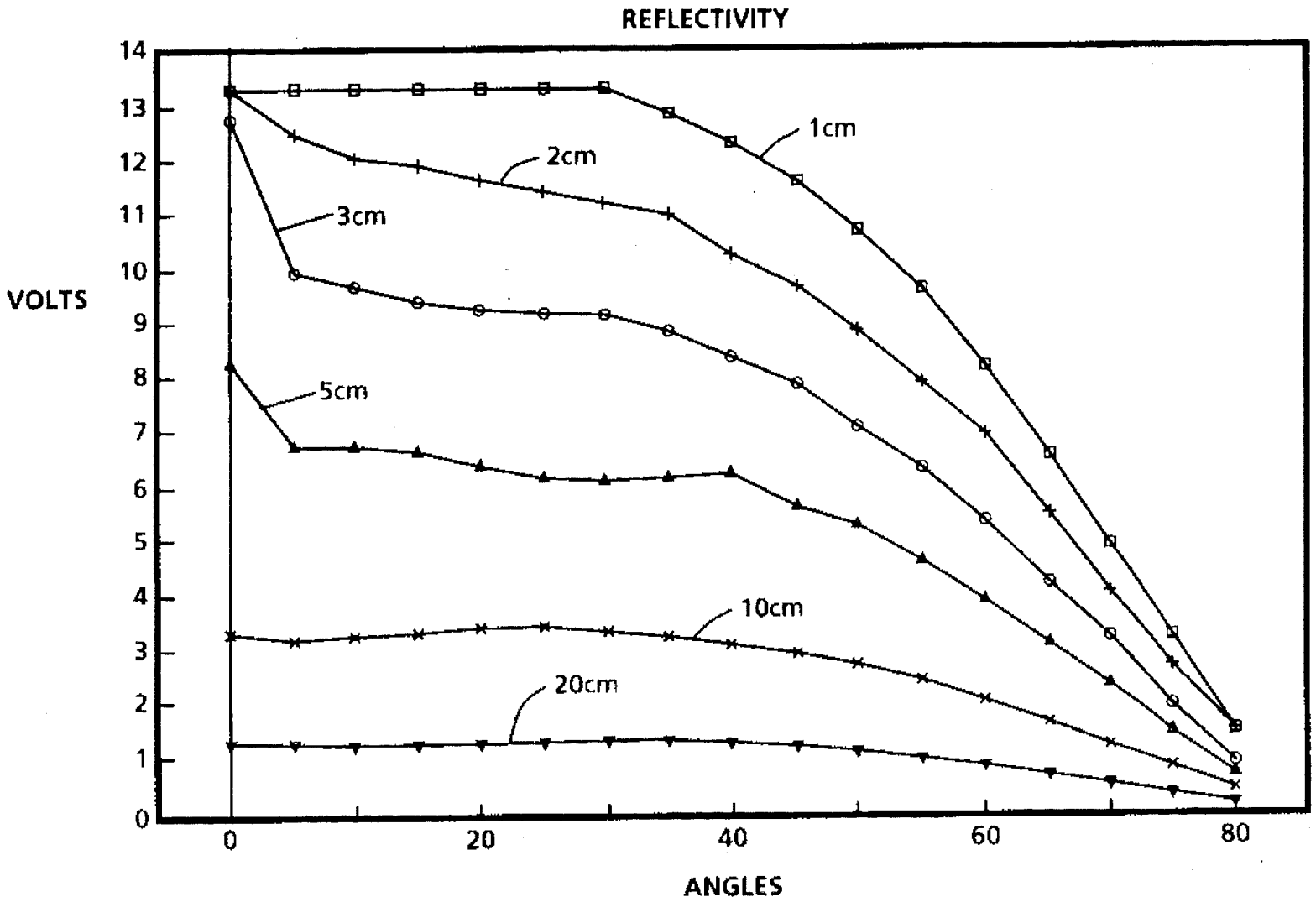
Figure 5:
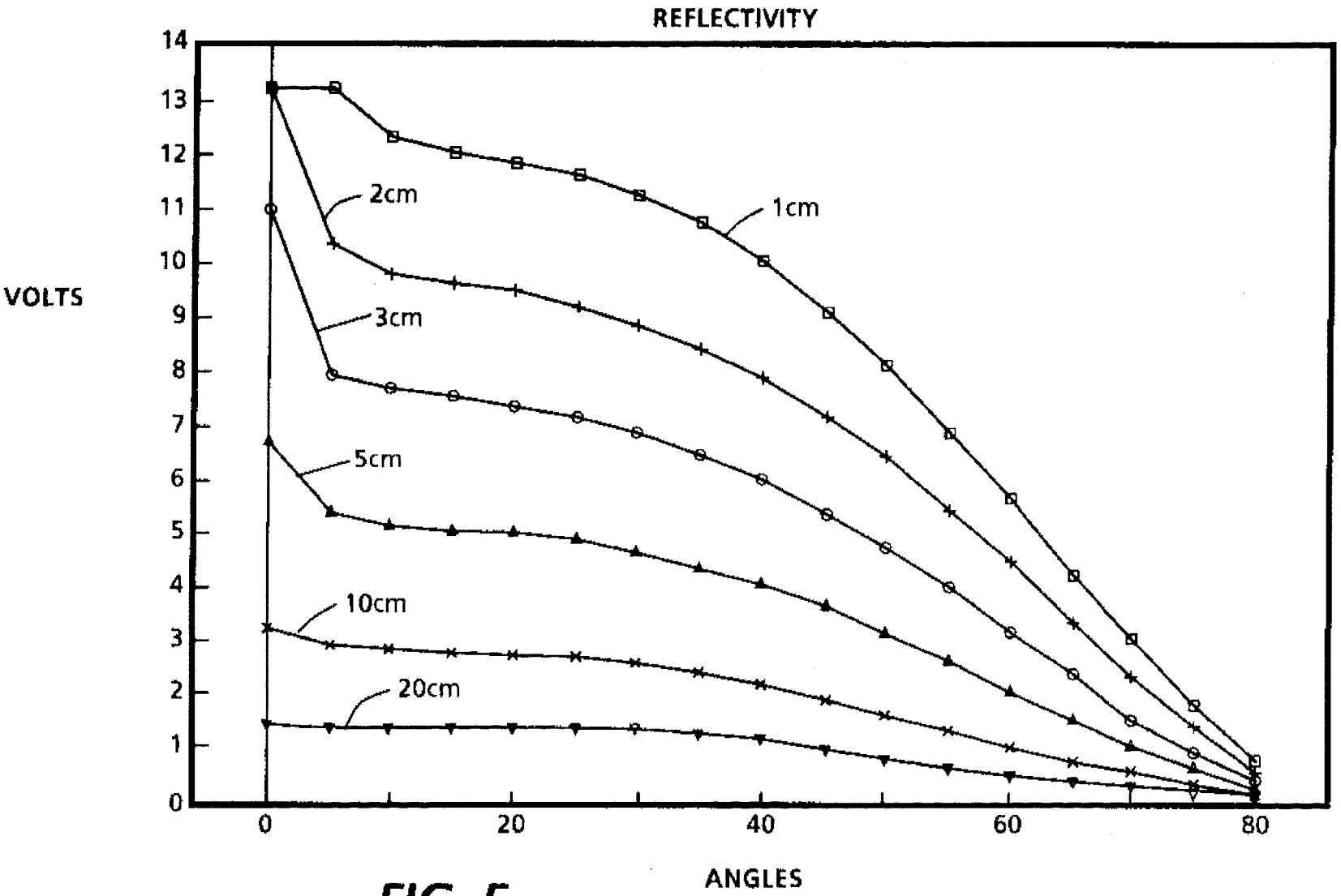

FIG. 3 shows the signal strength of the same CIRD illuminating a piece of retroreflector, Trimbrite Red (3M, St. Paul, Minn. 55144). As can be seen by comparing FIG. 3 to FIG. 2, the signal strength for normal illumination (0°) is much greater at the same distance from the retroreflector than from the photoreceptor. For instance, the signal off the photoreceptor with the detector at 5 cm is about 1.5 volts, whereas the signal off the retroreflector at the same 5 cm is about 10 volts. In addition, the range of angles at which the retroreflector can be illuminated by the CIRD and still return a strong signal is at least 60° or 70° from the normal in all directions. This result indicates that the CIRD can be placed at further distances and situated over a great range of angles with respect to the photoreceptor and still be able to detect easily the difference between the photoreceptor surface and a location marked with a retroreflector. FIGS. 4 and 5 show data taken with the same CIRD on white and yellow retroreflectors, Trimbrite White and Trimbrite Yellow (3M Corp., St. Paul, Minn. 55144), respectively. Again, these data show that the light detected by the CIRD is substantially greater that the light reflected from the photoreceptor surface over a wide range of angles and at great distances.

Other embodiments and modifications of the present invention may occur to those skilled in the art subsequent to a review of the information presented herein, these embodiments and modifications, as well as equivalents thereof, are also, included within the scope of this invention.

What is claimed is:

1. A process for generating images on paper which comprises applying in imagewise fashion to the paper a marking material containing a retroreflective filler material.

2. A toner composition for the development of electrostatic latent images which comprises a thermoplastic resin and a retroreflective filler material, said toner consisting of particles having an average diameter of about 100 microns or less.

3. A toner according to claim 2 wherein the retroreflecting filler is present in the toner in an amount of from about 10 to about 90 percent by weight.

4. A toner according to claim 2 wherein the retroreflecting filler has been treated with a charge control agent.

5. A toner according to claim 2 wherein the toner also contains a colorant.

6. A process for generating images which comprises generating an electrostatic latent image on an imaging member in an imaging apparatus; developing the latent image with a toner comprising a thermoplastic resin and a retroreflecting filler material; optionally transferring the developed image to a substrate; and optionally permanently affixing the transferred image to the substrate.

7. An imaging process which comprises (1) charging an imaging member in an imaging apparatus; (2) creating on the member a latent image comprising areas of high, intermediate, and low potential; (3) developing the low areas of potential with a first developer comprising a first toner comprising a thermoplastic resin, an optional colorant, and an optional retroreflecting filler; (4) subsequently developing the high areas of potential with a second developer comprising a second toner comprising a thermoplastic resin, an optional colorant, and an optional retroreflecting filler; and (5) transferring the developed images to a substrate, wherein a retroreflecting filler is necessarily present in either the first toner or the second toner, and wherein a colorant is necessarily present in a toner containing no retroreflecting filler.

8. An ink composition which comprises an aqueous liquid vehicle and a retroreflective filler material, said ink composition having a viscosity of no more than about 5 centipoise.

9. An ink according to claim 8 wherein the retroreflecting filler is present in the ink in an amount of from about 5 to about 80 percent by weight.

10. An ink according to claim 8 wherein the ink also contains a colorant.

11. A process which comprises incorporating into an ink jet printer an ink composition comprising a liquid vehicle, an optional colorant, and a retroreflecting filler, and causing droplets of the ink composition to be ejected in an imagewise pattern onto a substrate.

12. A process according to claim 11 wherein ink jet printer is a thermal ink jet printer, the ink comprises an aqueous liquid vehicle, and the droplets are caused to be ejected by heating the ink and causing bubbles to form therein.

13. A process for generating images which comprises generating an electrostatic latent image on an imaging member in an imaging apparatus; developing the latent image with a toner comprising a thermoplastic resin and a colorant; transferring the developed image to a substrate; optionally permanently affixing the transferred image to the substrate; and causing droplets of an ink composition comprising a liquid vehicle, an optional colorant, and a retroreflecting filler to be ejected in an imagewise pattern onto the substrate.

14. A liquid developer for the development of electrostatic latent images which comprises a nonaqueous liquid vehicle, an optional charge control agent, and retroreflective filler particles, said developer having a resistivity of at least about $10^8$ and a viscosity of no more than 500 centipoise at the temperature at which development occurs.

15. A liquid developer according to claim 14 wherein the developer contains toner particles comprising a mixture of a resin substantially insoluble in the liquid vehicle at the temperature at which development occurs and at least one retroreflective filler particle per toner particle.

16. A liquid developer according to claim 15 wherein the toner particles also contain a colorant.

17. A liquid developer according to claim 15 wherein the developer also contains toner particles comprising a mixture of a resin and a colorant.

18. A liquid developer according to claim 14 wherein the developer contains retroreflective filler particles and a polymeric material soluble in the liquid vehicle at the temperature at which development occurs.

19. A liquid developer according to claim 18 wherein the developer also contains a colorant.

20. A liquid developer according to claim 19 wherein the colorant comprises pigment particles.

21. A liquid developer according to claim 19 wherein the colorant comprises a dye.

22. A liquid developer according to claim 14 wherein the developer is suitable for electrophoretic development processes and wherein the developer has a resistivity of more than about $5\times10^9$ ohm-cm and a viscosity of no more than about 20 centipoise at the temperature at which electrophoretic development occurs.

23. A liquid developer according to claim 14 wherein the developer is suitable for polarizable liquid development processes and wherein the developer has a resistivity of from about $10^8$ to about $10^{11}$ ohm-cm and a viscosity of from about 25 to about 500 centipoise at the temperature at which polarizable liquid development occurs.

24. A liquid developer according to claim 14 wherein the retroreflective filler particles are present in the developer in an amount of from about 5 to about 80 percent by weight.

25. An imaging process which comprises generating an electrostatic latent image on an imaging member and contacting the latent image with a liquid developer comprising a nonaqueous liquid vehicle, a charge control agent, and toner particles comprising retroreflective filler particles, thereby causing the toner particles to migrate through the liquid and develop the latent image.

26. An imaging process which comprises generating an electrostatic latent image on an imaging member, applying to an applicator a liquid developer comprising a nonaqueous liquid vehicle and retroreflective filler particles, and bringing the applicator into sufficient proximity with the latent image to cause the image to attract the developer onto the imaging member, thereby developing the image.

27. An imaging process which comprises applying a liquid to a substrate in imagewise fashion, followed by applying retroreflective filler particles to the liquid image, wherein the liquid is curable to a solid and the process comprises applying a curable liquid to a first substrate in an image pattern, optionally transferring the curable liquid image to a second substrate, subsequently contacting the curable liquid image with retroreflective filler particles so that the retroreflective filler particles adhere to the curable liquid image, optionally transferring the curable liquid and the retroreflective filler particles in image pattern to a third substrate, and curing the curable liquid in the image pattern to a solid.

28. A process for controlling a reproduction system, comprising the steps of: (1) scanning an image to detect retroreflective filler material in at least one marking material forming the image; and (2) issuing instructions to the reproduction system, wherein the instructions cause the reproduction system to take an action selected from the group consisting of:

(a) prohibiting reproduction of those portions of the image formed by marking material containing retroreflective filler material, and reproducing of all other portions of the image;

(b) prohibiting reproduction of any part of the image upon detection of retroreflective filler material;

(c) reproducing only those portions of the image formed by marking material containing retroreflective filler material;

(d) reproducing portions of the image formed by marking material containing retroreflective filler material in a different manner from that in which the system reproduces portions of the image formed by marking material not containing retroreflective filler material; and (e) identifying a source of the image on the basis of detection of retroreflective filler material.

29. A process for determining the relative position of a movable component in an imaging apparatus which comprises (a) providing on the movable component at least one mark with a marking material containing a retroreflective filler material; (b) positioning an illumination source so that illumination from the illumination source strikes the mark on the movable component; (c) positioning an illumination detector so that it can detect illumination reflected from the retroreflective filler material on the movable component; and (d) calculating the relative position of the movable component using information provided from the illumination detector.

30. A process according to claim 29 wherein the illumination source is positioned so that illumination from the illumination source strikes the mark on the movable component at an angle of from 0° to about 70° from a line normal to the surface of the movable component.

31. A process according to claim 29 wherein the illumination source is positioned so that illumination from the illumination source strikes the mark on the movable component at an angle of from about 5° to about 70° from a line normal to the surface of the movable component.

32. A process according to claim 29 wherein the illumination detector is positioned to detect illumination reflected from the retroreflective filler material on the movable component at an angle of from about 10° to about 60° from a line drawn between the illumination source and the retroreflective filler material on the movable component.

33. A process according to claim 29 wherein the movable component is an imaging member.

34. A process according to claim 33 wherein the movable component is a photoreceptor.

35. A process according to claim 29 wherein the movable component is an intermediate transfer member.

* * * * *